US006497421B1

(12) United States Patent
Edgerley et al.

(10) Patent No.: US 6,497,421 B1
(45) Date of Patent: Dec. 24, 2002

(54) SKATING AND OTHER APPARATUS

(75) Inventors: David Edgerley, London (GB); Etienne Iliffe-Moon, Gloucester (GB)

(73) Assignee: Innovo International Limited, Hoddeston (GB)

( * ) Notice: Subject to any disclaimer, the term of this patent is extended or adjusted under 35 U.S.C. 154(b) by 0 days.

(21) Appl. No.: 09/348,094

(22) Filed: Jul. 6, 1999

(30) Foreign Application Priority Data

Jul. 7, 1998 (GB) ..... 9814741
Nov. 16, 1998 (GB) ..... 9824943

(51) Int. Cl.[7] ..... A63C 17/02
(52) U.S. Cl. ..... 280/11.19; 280/11.208; 280/11.26; 280/11.27; 280/11.201
(58) Field of Search ..... 280/841, 11.19, 280/11.201, 11.204, 11.206, 11.207, 11.208, 11.209, 11.211, 11.212, 11.215, 11.216, 11.217, 87.042; 188/1.12, 5, 4 R

(56) References Cited

U.S. PATENT DOCUMENTS

| | | | | |
|---|---|---|---|---|
| 2,245,769 A | * | 6/1941 | Flamm | 280/11.19 |
| 2,725,238 A | * | 11/1955 | Day | 280/11.2 |
| 3,790,187 A | * | 2/1974 | Radu et al. | 280/11.2 |
| 3,841,004 A | * | 10/1974 | Gray et al. | 36/72 R |
| 3,872,554 A | | 3/1975 | Wolfertz et al. | 24/206 B |
| 3,995,382 A | * | 12/1976 | Smith | 36/72 R |
| 4,021,888 A | | 5/1977 | Aimar | 24/16 PB |
| 4,123,079 A | * | 10/1978 | Biskup | 280/87.042 |

(List continued on next page.)

FOREIGN PATENT DOCUMENTS

| | | |
|---|---|---|
| AU | 3855485 | 12/1987 |
| AU | 153623 | 8/1989 |
| EP | 22907 | 1/1981 |

(List continued on next page.)

*Primary Examiner*—Brian L. Johnson
*Assistant Examiner*—Bridget Avery
(74) *Attorney, Agent, or Firm*—Thomas M. Freiburger

(57) ABSTRACT

A training roller skate has rollers or wheels and wheel mounts, at least one wheel mount being movable, preferably in a direction transverse to the wheel axis, to permit contact between a wheel associated surface and a motion inhibitor that inhibits rotary motion of the wheel. The skate has a front shoe part defining a forward platform portion to support a skater's foot and further defining a toe cap support with which a separately formed toe cap is snap-fittedly attached to permit toe caps of alternative shapes and forms to be selectively attached to the toe cap support. The forward platform portion may have an attached brake pad of frictional material that is engageable by a roller, the brake pad being provided integrally with a projection frictionally to engage the ground when the platform is tilted. At least one of the wheels or rollers has an associated surface provided with at least one projection or recess, and a main body of the skate is provided with at least one projection or recess, and a main body of the skate is provided with at least one recess or projection dimensioned for mating engagement with the surface projection or recess, the wheel mount being movable selectively to effect such mating engagement, to inhibit both forward skating and rearward skating and out of such mating engagement, to permit skating in at least the forward direction. The roller skate may further include a forward carriage and a rearward carriage, with a length adjustment connection between them.

31 Claims, 14 Drawing Sheets

U.S. PATENT DOCUMENTS 4,229,862 A 10/1980 Kubelka ..... 24/685 K
4,295,655 A 10/1981 Landay et al. ..... 280/11.2
4,304,417 A * 12/1981 Hsieh ..... 280/11.26
4,314,707 A * 2/1982 Welch ..... 280/11.209
4,433,458 A 2/1984 Ouvieri ..... 24/191
4,553,767 A 11/1985 Robjent et al. ..... 280/11.21
4,708,352 A * 11/1987 Vullierme ..... 280/11.26
4,932,676 A 6/1990 Klamer ..... 280/11.2
4,995,174 A * 2/1991 Hong et al. ..... 36/72 R
5,171,033 A * 12/1992 Olson et al. ..... 280/11.22
5,192,099 A * 3/1993 Riutta ..... 280/11.2
5,210,963 A * 5/1993 Harwood ..... 36/77 R
5,320,367 A * 6/1994 Landis ..... 280/11.2
5,342,071 A * 8/1994 Soo ..... 280/11.22
5,348,320 A 9/1994 Gay ..... 280/11.2
5,357,695 A * 10/1994 Lu ..... 36/115
5,400,484 A 3/1995 Gay ..... 24/585
5,462,297 A * 10/1995 Lee ..... 280/11.2
5,484,149 A * 1/1996 Lee ..... 280/11.26
5,511,803 A 4/1996 Klukos ..... 280/11.2
5,511,805 A 4/1996 McGrath ..... 280/11.2
5,522,609 A 6/1996 Gay ..... 280/11.2
5,678,833 A * 10/1997 Olson et al. ..... 280/11.22
5,711,092 A * 1/1998 Despres et al. ..... 36/72 R
5,845,913 A * 12/1998 Santarsiero ..... 280/11.19
5,848,796 A * 12/1998 Meibock et al. ..... 280/11.22
5,887,361 A * 3/1999 Cabanis et al. ..... 36/115
5,890,722 A * 4/1999 Smith et al. ..... 280/11.2
5,913,526 A * 6/1999 Olson et al. ..... 280/11.22
5,946,823 A * 9/1999 Yates ..... 36/11.5
5,954,348 A * 9/1999 Santarsiero et al. ..... 280/11.21
5,992,862 A * 11/1999 Mitchell ..... 280/11.2
6,000,721 A * 12/1999 Pfaeffle ..... 280/890
6,045,144 A * 4/2000 Wong ..... 280/11.26
6,050,574 A * 4/2000 Olson et al. ..... 280/11.22
6,227,551 B1 * 5/2001 Roy ..... 280/11.223
6,322,088 B1 * 11/2001 Klamer et al. ..... 280/11.27
6,371,494 B1 * 4/2002 Bonaventure et al. ... 280/11.19

FOREIGN PATENT DOCUMENTS

| | | |
|---|---|---|
| EP | 0152261 | 8/1985 |
| EP | 0214061 | 3/1987 |
| EP | 0328344 | 8/1989 |
| FR | 9300694 | 4/1995 |
| GB | 609453 | 9/1948 |
| GB | 1062467 | 3/1967 |
| GB | 1229320 | 4/1971 |
| GB | 1497546 | 1/1978 |
| GB | 1508181 | 4/1978 |
| GB | 2018139 | 10/1979 |
| GB | 1578302 | 11/1980 |
| GB | 2090904 | 7/1982 |
| GB | 2037869 | 10/1982 |
| GB | 2130896 | 6/1984 |
| GB | 2090904 | 5/1985 |
| GB | 2168900 | 7/1986 |
| WO | 9532036 | 12/1994 |
| WO | 9605895 | 8/1995 |
| WO | 9617661 | 11/1995 |

* cited by examiner

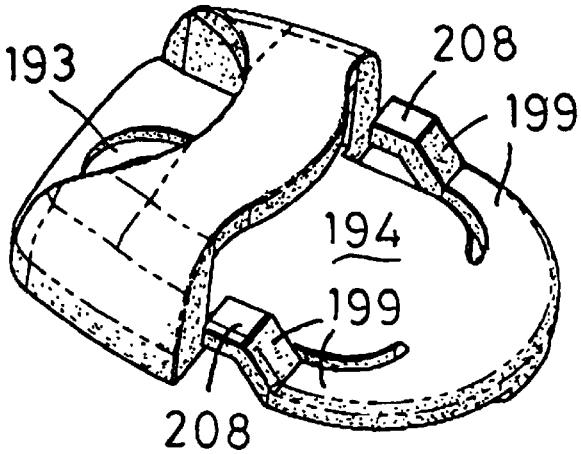
FIG.22
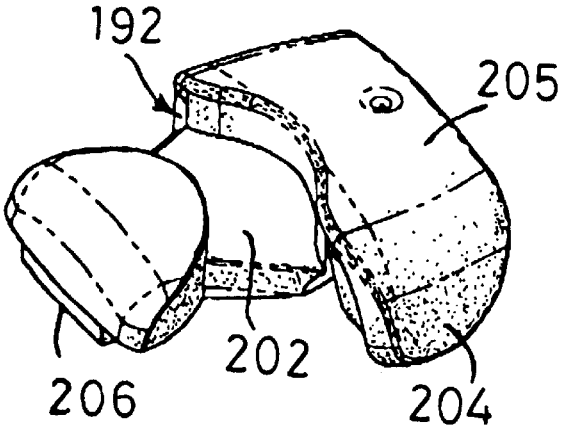
FIG.23
FIG.24
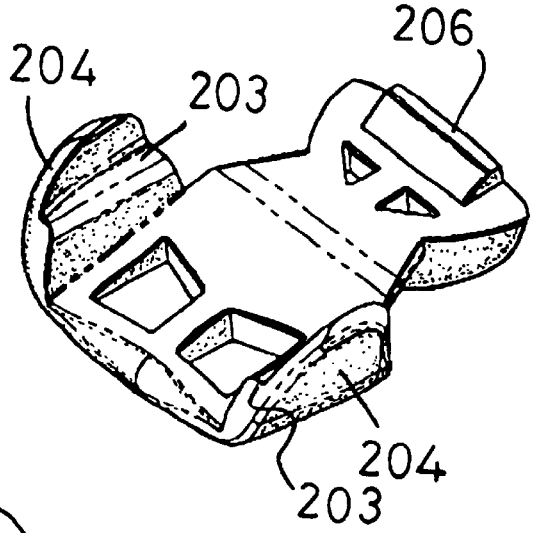
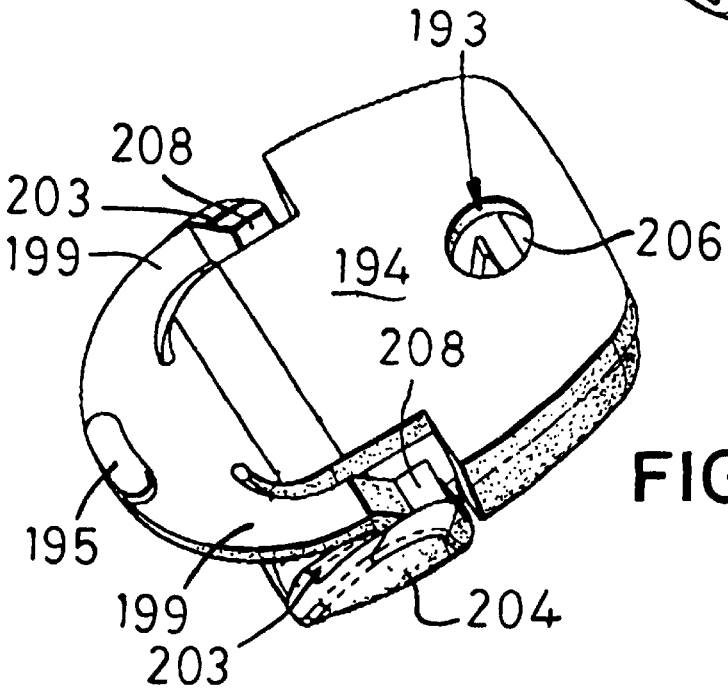
FIG.25

SKATING AND OTHER APPARATUS

TECHNICAL FIELD

This invention relates to skating and other apparatus, particularly—but not exclusively—to roller skates, i.e. skates comprising platform means to support a skater, the platform being mounted on a pair of front wheels or rollers and a pair of rear wheels or rollers.

BACKGROUND ART

Although most conventional roller skates have both pairs of wheels continuously capable of free-wheeling in both directions (to permit both forward and rearward skating), trainer roller skates have recently become popular for learners, e.g. children. These trainer roller skates are selectively settable (a) to provide for bi-directional wheel rolling motion, i.e. for forward and rearward skating, and (b) to provide for uni-directional wheel rolling motion, i.e. to inhibit rearward skating. Some trainer roller skates are additionally settable (c) to provide for no wheel rolling motion, i.e. to inhibit both forward and rearward skating.

Examples of such trainer roller skates are disclosed in U.S. Pat. No. 4,943,676 and French Patent No. 2700705. Each has an axle upon which the front wheels are mounted, an axle upon which the rear wheels are mounted, and a fixed spacing between the two axles. Each also has setting means providing for the movement of a member (e.g. a pawl or a lever) in to or out of interference with at least one wheel.

The operation of the roller skates per U.S. Pat. No. 4,932,676 in, for example, state (b) is often noisy due to the ratcheting action required for its pawl. The operation of the roller skates per French No. 2700705 is in practice not wholly satisfactory as the intended frictional engagement between its parts in, for example, state (b) or (c) is sometimes insufficient so that the intended function cannot be wholly relied upon.

SUMMARY OF THE INVENTION

With a view to overcoming or at least reducing the above-mentioned and/or other disadvantages of the prior art, the present invention, in one aspect thereof, provides a training roller skate comprising rollers or wheels and mounting means therefor, and further comprising motion inhibiting means for contacting a surface associated with at least one of said wheels to inhibit its rotary motion, characterised in that the mounting means for said at least one wheel is movable (preferably in a direction transverse to the wheel axis) to permit contact between the said wheel associated surface and the motion inhibiting means.

Preferably said mounting means is operably associated with setting means and is constrained in a first position, out of said contact, by setting of the setting means in a first positional setting, a second positional setting of the setting means permitting said contact to occur in use automatically upon a user's attempt to skate backwards.

In one preferred embodiment the trainer roller skate's setting means is additionally settable to a third positional setting in which rotation of the wheels is inhibited in both directions such as to inhibit both forwards skating and rearwards skating.

In one preferred embodiment of the trainer roller skate a platform is provided to support a skater's foot, said mounting means includes a carrier member carrying an axle upon which the said at least one wheel is mounted, and the skate comprises means mounting the carrier member for relative movement with respect to the platform—preferably in a direction transverse to the axis of said axle.

Preferably the setting means includes a rotatably mounted control element having an eccentric cam member engageable with a part of said carrier member such as to position and/or effect location of the axle carrying carrier member as aforesaid.

Advantageously the trainer roller skate comprises first and second motion inhibition means, the first motion inhibition means being engageable by said wheel associated surface when the setting means occupies said second position, and the second motion inhibition means being engageable by one or both said wheels (or a surface thereof) when the setting means occupies said third position.

Preferably the first motion inhibition means comprises a pad of frictional material. The pad may have an arcuate surface engageable by said wheel associated surface, and preferably has two such arcuate surfaces spaced apart laterally of the skate and engageable by surfaces associated with both said wheels.

Advantageously the pad comprises an integral projection directed forwardly of the skate to provide a so-called "toe brake"that can engage the skating surface (e.g. the ground) when in use the skate is tilted.

In one embodiment of the present invention the setting means is operable on the carrier member to position the axle, in said third position, for engagement of said at least one surface by both the first and second motion inhibition means. Preferably, in this case the second motion inhibition means comprises a friction pad.

In an alternative (and preferred) embodiment of the present invention the setting means is operable on the carrier member to position the axle, in said third position, for engagement of said at least one surface by the second motion inhibition means only. Preferably, in this case, the second motion inhibition means comprises a dog tooth clutch arrangement comprising a positionally fixed tooth engageable in one of a plurality of slots provided in the outer surface of a hub of one said wheel.

Advantageously a pair of such dog teeth are provided, one to each side of the trainer roller skates, to be engageable as aforesaid with a hub of each said wheel.

According to a second aspect of the present invention there is provided a roller skate comprising

- a front shoe part defining a forward platform portion to support a skater's foot and further defining toe cap support means, and
- a separately formed toe cap attached (e.g. removably) to said toe cap support means.

Such an arrangement permits toe caps of alternative shapes and forms (e.g. representing cartoon characters) to be selectively attached to the toe cap support means.

Preferably inter-engageable snap-fit means are associated with the toe cap and the toe cap support means to permit their mutual attachment in a snap-fitted manner.

According to a third aspect of the present invention there is provided a roller skate including

- a platform to support a skater's foot,
- at least one roller mounted movably with respect to the platform, and
- a brake pad of frictional material attached to said platform and engageable by said roller, said brake pad being provided integrally with a projection frictionally to engage the skating surface, e.g. the ground, when the platform is tilted.

Preferably the projection is directed forwardly of the skate to constitute a so-called "toe brake".

Preferably the skate is a training skate and the brake pad, when engaged by said roller, serves to inhibit rearward motion of the skate. member bestrides this pair of surfaces such that the latter resist laterally inward motion of the fingers and their laterally directed tabs or barbs such as to prevent disengagement of the lock members from the said other carriage.

According to a sixth aspect of the present invention there is provided a fastening arrangement (preferably, but not exclusively, for a roller skate—e.g. a training roller skate), the fastening arrangement comprising:

a strap having (preferably between edges of the strap) a plurality of recesses in a major surface of the strap; and a buckle having a body member in the form of an arched structure through which the strap is to extend and further having a pawl member disposed between said major surface of the strap—when the latter is in the buckle—and a facing wall of the body member, said pawl member having a tip end for entry into any selected one of said recesses, characterised in that one of said members is provided with a laterally-extending element (e.g. a rib or a wall), and the other of said members is provided with a laterally-extending channel to accommodate the element and define therewith a pivot axis for the pawl member.

In one preferred arrangement the pawl member is molded of plastics material integrally with a pair of side wings that, when displaced or deformed, provide a resilient restoring force to urge the tip end of the pawl member towards said major surface and for engagement into a selected one of said recesses.

Advantageously each of side wings is provided at its free end with a depending foot to be accommodated between a side wall of the body member and an adjacent edge of the strap when the latter extends through the body member.

Preferably said fastening arrangement is incorporated in a skate, e.g. an ice skate or a roller skate (e.g. a training or a conventional two-axle roller skate or a training or a conventional in-line roller skate).

According to a fourth aspect of the present invention there is provided a training roller skate comprising a main body, rollers or wheels and mounting means therefor, wherein at least one of said wheels has a surface associated therewith provided with at least one projection or recess, said body is provided with at least one recess or projection dimensioned for mating engagement with the (or at least one of the) said surface projection or recess, and wherein the mounting means for said at least one wheel is movable selectively to effect such mating engagement—to inhibit both forwards skating and rearwards skating—and out of such mating engagement—to permit skating in at least the forwards direction.

According to a fifth aspect of the present invention there is provided a roller skate comprising:

a forward carriage and a rearward carriage, length adjustment means interconnecting the first and second carriages; and locking means to lock the interconnected first and second carriages in a selected one of a plurality of predetermined relative positions;

wherein the locking means comprises, to each side (of the skate's longitudinal central axis):

an elongate channel having one said wall thereof formed with a plurality of slot-like openings depending from one of said carriages; and a lock member mounted for pivoting motion on the other of said carriages, said lock member having a first finger to extend through an opening in a wall of said other carriage and abut against the opposite wall of said recess, and having a second finger to extend through the same or another opening in said carriage wall and to engage into a selected one of the slot-like openings.

Preferably the two first fingers are laterally resilient and have laterally directed tabs or barbs to resist passage of the first fingers through the first-mentioned openings.

Preferably one of said carriages has an elongate beam provided with a pair of upwardly directed surfaces and, when the said carriages are interconnected, the lock According to a seventh aspect of this invention there is provided a fastening arrangement (preferably, but not exclusively, for a roller skate—e.g. a training roller skate), the fastening arrangement comprising a strap and a buckle releasably engageable with the strap, wherein the strap has a major surface provided with a plurality of recesses therein and the buckle comprises a pawl member mounted on a body member—through which passes the strap to be fastened—and such as to be movable into and out of an engaged state in which the pawl member is in selective engagement of one or more individual recesses, wherein one of said members is molded of plastics material integrally with at least one inherently resilient limb that is engageable of the other of said members to provide a restoring force countering disengagement of the pawl member from its said state of recess engagement.

It is considered that fastening means according to the last two mentioned aspects of the present invention may be used in a wide range of varied applications where a length-adjustable, quick-release binding is required. Such applications include luggage straps, rucksack shoulder straps, ankle straps for footwear, e.g. sandals and skates (such as roller skates and in-line skates) and toe straps for footwear, e.g. orthopaedic shoes. Preferably however, said fastening arrangement is incorporated in a skate, e.g. an ice skate or a roller skate (e.g. a training or a conventional two-axle roller skate or a training or a conventional in-line roller skate).

BRIEF DESCRIPTION OF THE DRAWINGS

By way of example embodiments of this invention will now be described with reference to the accompanying drawings of which:

FIG. 22 is a top perspective view of one part of the two-part buckle shown in FIGS. 18–21, FIG. 23 is a top perspective of the other part of the two-part buckle shown in FIGS. 18–21, FIG. 24 is a bottom perspective view of the part shown in FIG. 23, FIG. 25 is a bottom perspective view of the two parts shown in FIGS. 22–24 when coupled to one another.

DETAILED DESCRIPTION OF EXAMPLES(S) OF THE INVENTION

Figure 1:
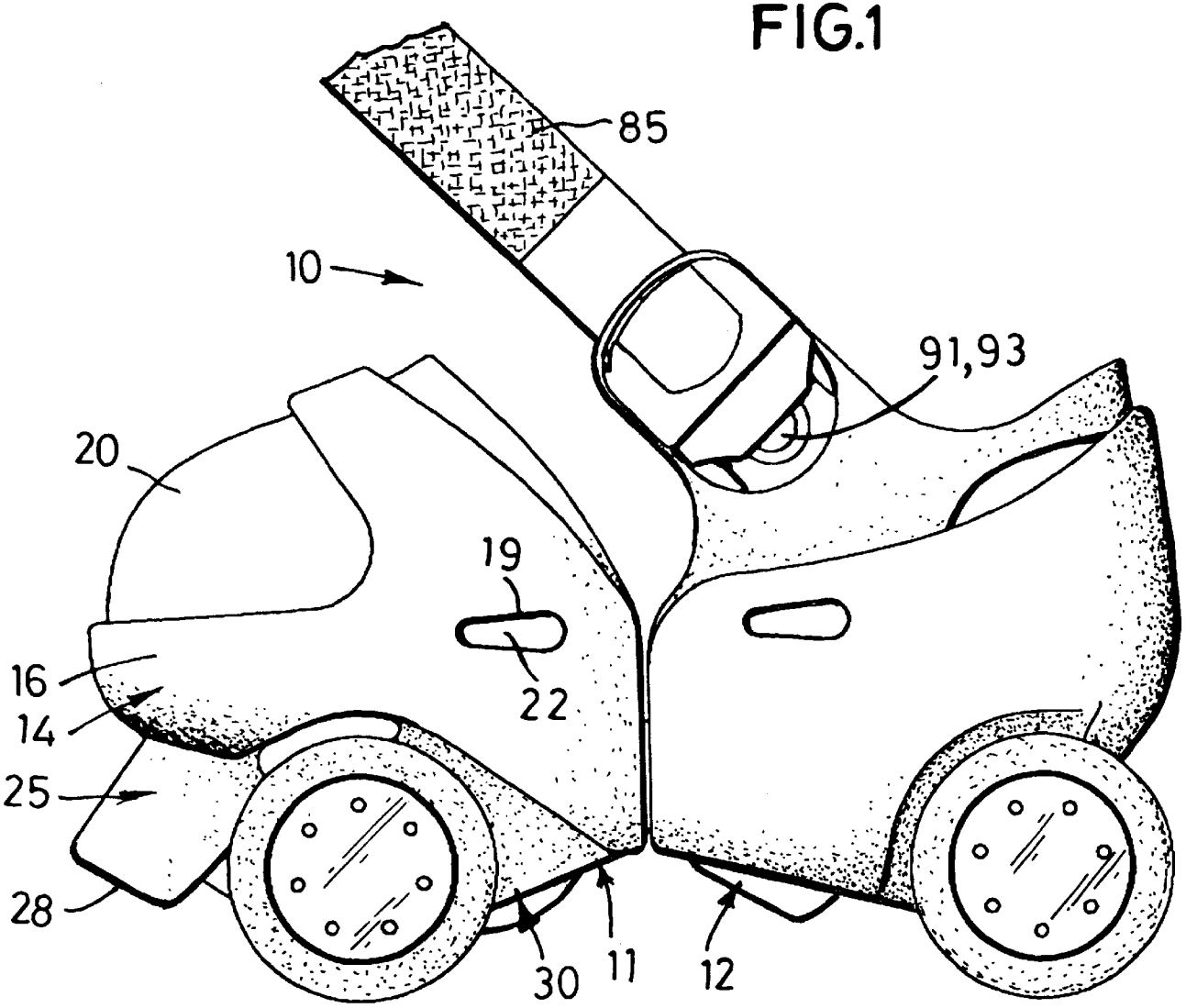
FIG. 1 is a side view, from the left, of a right-foot training roller skate according to the present invention, an ankle strap being shown broken away.

The illustrated roller skate 10 is a trainer roller skate comprising a front carriage 11 and a rear carriage 12 interconnected with one another by means 13 (FIG. 9, described below) permitting adjustment of the overall skate length and setting the skate to that adjusted length. The front carriage 11 comprises a front shoe part 14 defining a front sole plate or platform provided with a plurality of longitudinally directed parallel ribs of channels 9 to aid friction between the top platform surface and the under surface of the shoe worn by the user of the skate. The front shoe part 14 is also provided with an upturned lip 16 around its forward tip and two sides. The upturned lip 16 is integrally molded at its forward tip or toe end with a rearwardly directed tab 17 and is also integrally molded with a cross-over band 18 adjacent the rear end of shoe part 14 to interconnect the two sides of the shoe part 14.

Each side of shoe part 14 is provided adjacent its rear end with an elongate, somewhat pear-shaped, aperture 19. A toe cap 20, formed as a separate molding, is snap-fitted into the open cavity formed by the upturned lip 16 and cross-over band 18 of shoe part 14. For this, the toe cap 20 is provided at its forward end with an elongate slot to receive fittingly the shoe part's rearwardly directed tab 17. The toe cap 20 is also provided at its sides with rearwardly directed fingers 21 that are inherently resilient and urged laterally outwardly of the toe cap 20, the external surface of each finger 21 being formed with an elongate, somewhat pear-shaped tab 22 corresponding to the shape of apertures 19 in the shoe part 14. The inherent resiliency of the toe cap's integrally molded fingers 21 urges their tabs 22 into snap-fitting engagement of the shoe part's apertures 19 whereby, with forward tab 17 and cross-over band 18, the toe cap 20 is held captive in and by the shoe part 14. Nevertheless, the toe cap 20 can be readily removed, for interchange with one having a different colour and/or surface formation in either two-dimensional or three-dimensional form (e.g. portraying a cartoon character). Such interchange is readily achieved by simply depressing the fingers 21 inwards and pulling the toe cap 20 rearwardly out of the shoe part 14.

Figure 3:
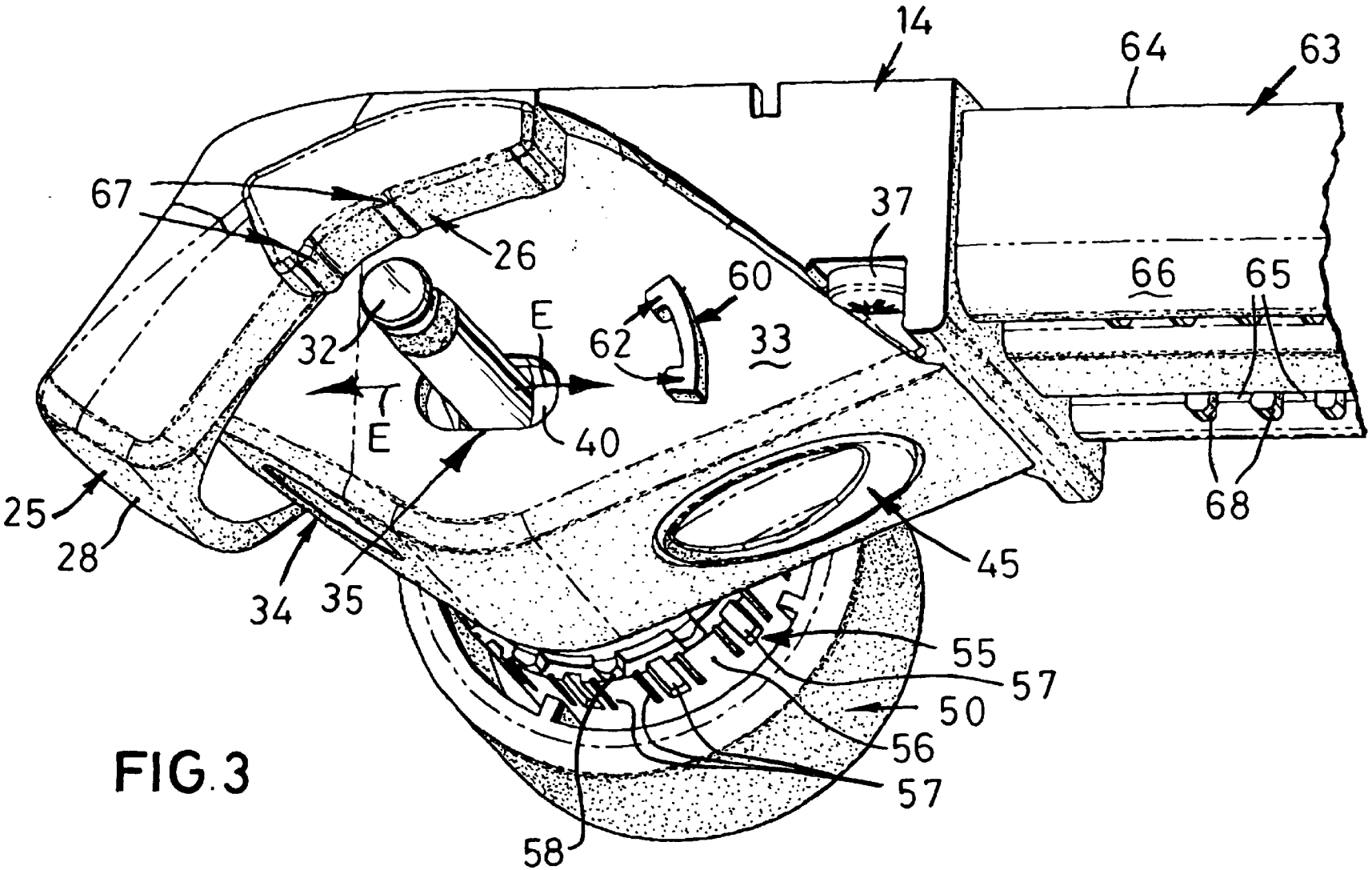
FIG. 3 is an enlarged perspective view of the underside of part of the front of the skate shown in FIG. 1.

The underside of shoe part 14 is integrally molded with a depending boss 24 that extends through a bore in a brake pad 25. The brake pad 25 is molded of frictional plastics material to provide, on each side, an arcuate frictional surface 26 (FIG. 3) for braking engagement of the roller skate's front wheels (in a manner to be described below). The brake pad 25 is also provided, at the front, with a forwardly and downwardly directed integral projection 28 for braking engagement of the skating surface (e.g. the ground or a shaped skating structure supported thereon), such braking engagement being achieved when the skater tilts the skate. The one-piece molding of brake pad 25, to provide the braking surfaces 26 and 28 for the two different functions of wheel braking and of conventional skate braking, reduces the skate's manufacturing and assembly costs.

Figure 2:
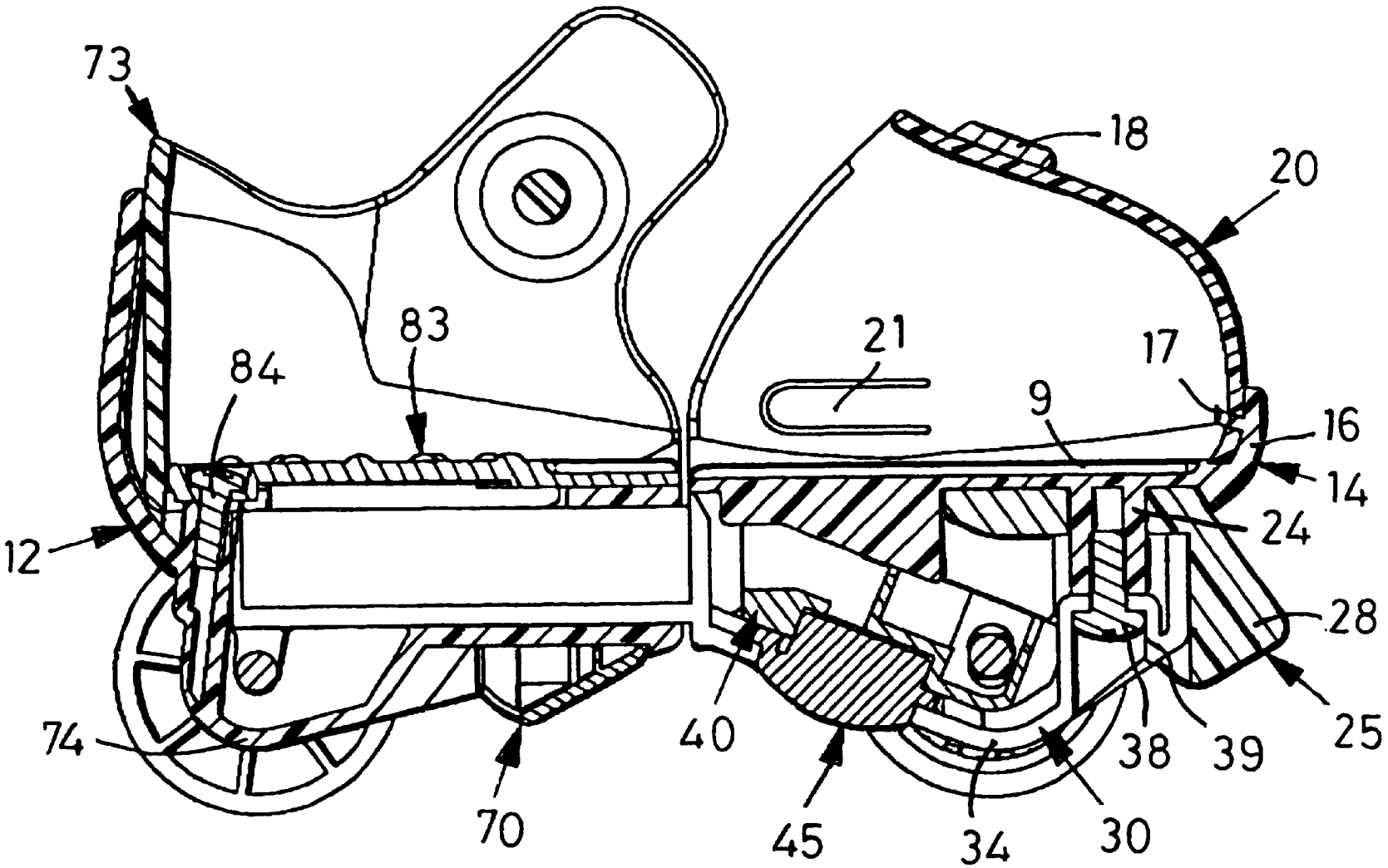
FIG. 2 is a longitudinal section through the skate of FIG. 1 when viewed from the right.
Figure 4:
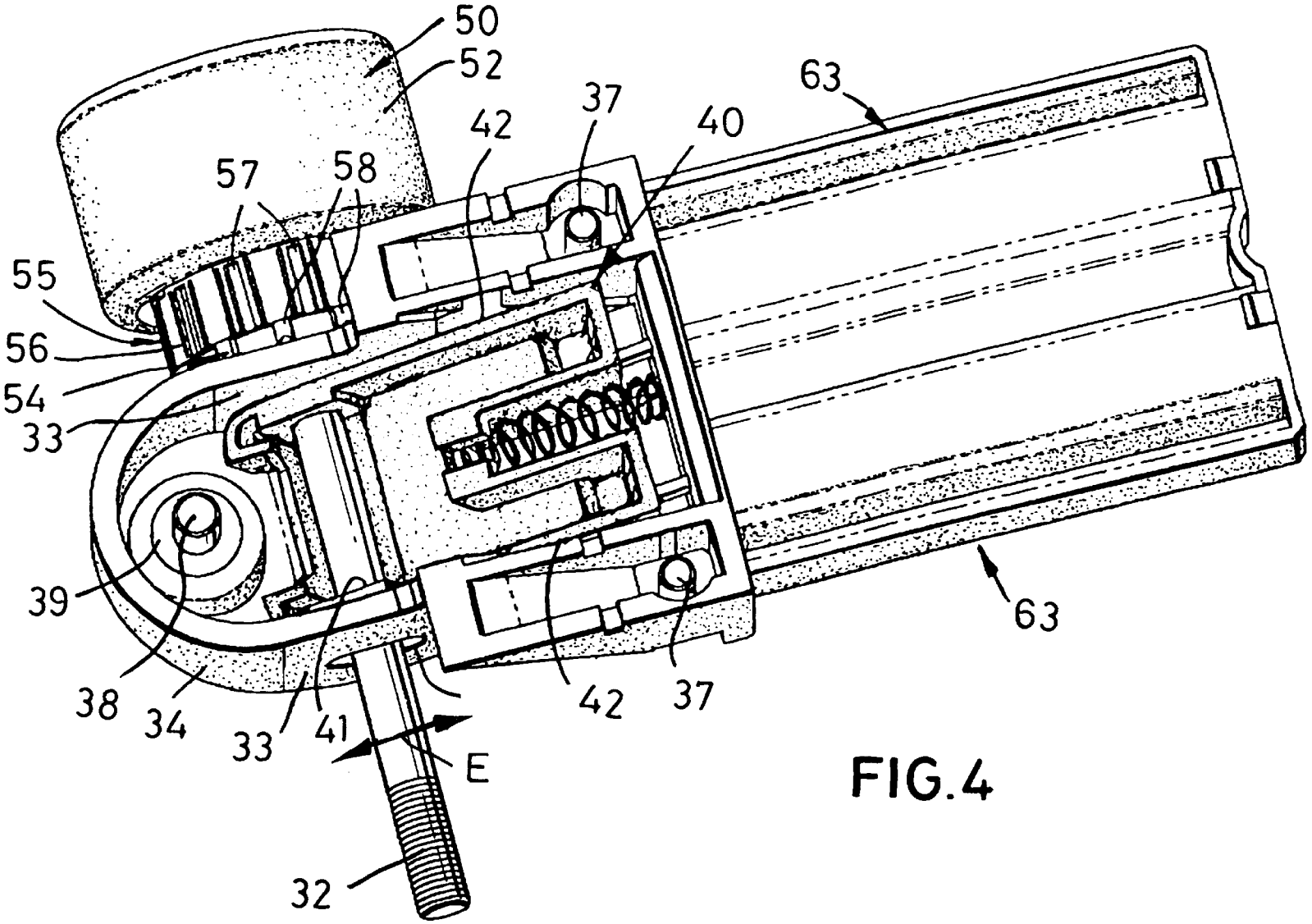
FIG. 4 is a plan view of a portion of the front of the skate of FIG. 1 with some parts omitted for clarity of illustration.

A molded carrier assembly 30 for the front axle 32 is mounted beneath the front shoe part 14. The carrier assembly 30 comprises an axle carrier 40 (FIG. 4) disposed within an outer housing 34 that is attached to the shoe part 14. Such attachment is by a pair of laterally spaced rear screws 37 and by a single front screw 38 (FIG. 2). The head of front screw 38 sits within an integrally molded boss 39 that is in axial alignment with the boss 24 depending from the underside of shoe part 14, and the one front screw 38 serves to interconnect and retain together the shoe part 14, the carrier assembly 30 and the dual function brake pad 25.

Each of the side walls 33 of outer housing 34 is provided with an elongate horizontal slot 35 having semi-circular ends, the two slots 35 being in registry with one another in side view. The front axle 32 extends through the two slots 35 and also through a vertical slot 41 in the side walls 42 of the axle carrier 40. The overlying slots 35,41 to each side of the skate functionally serve as bearings that locate the axle 32 in a position (relative to the outer housing 34) that is set or determined by the position of the inner axle carrier 40 in relation to the housing 34.

Figure 5:
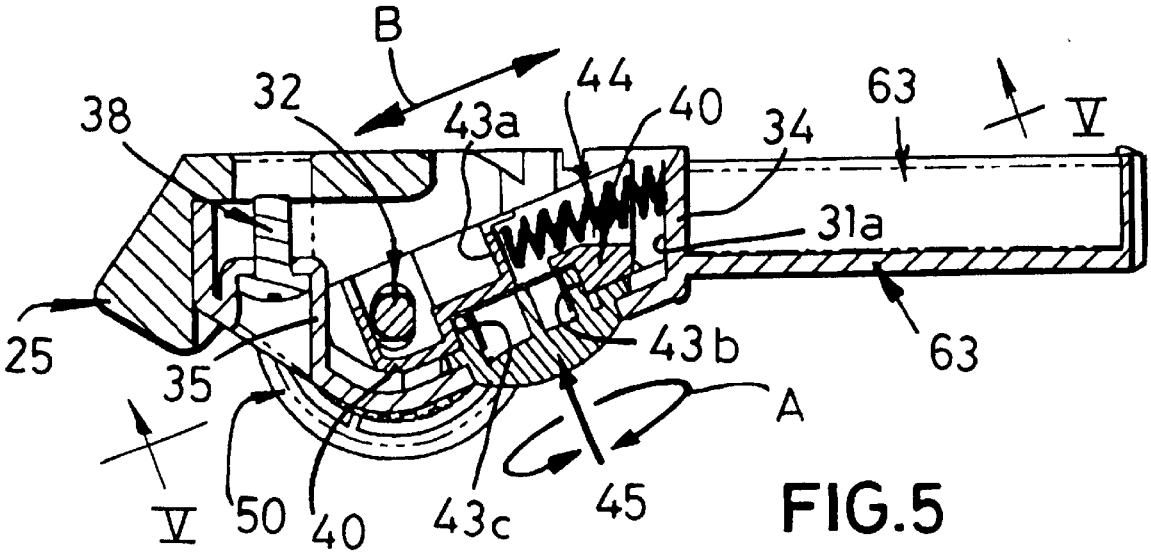
FIG. 5 is a longitudinal cross-sectional view of the part shown in FIG. 1.

The axle carrier 40 is mounted in housing 34 such as to be slidable therein in an inclined forwards and rearwards direction (as shown by arrow B in FIG. 5), the limits of such motion being at least in part defined by the semi-circular ends of the two slots 35 in housing 34. A low force, coiled compression spring 44 acts between a main rear wall 31*a* of housing 34 and an upper rear wall 43*a* of axle carrier 40 to urge the carrier 40 forwardly. A control knob 45 molded of plastics material is mounted for rotation in a circular-aperture 47 the bottom under surface of the carrier assembly's housing 34. Control knob 45 is molded integrally with an arrow-like rib on its outer surface to provide an indicator of its angular position and has an integrally molded cam member 46 located eccentrically of its inner surface. The eccentric cam member 46 has a predominantly three-lobed surface offset from the rotational axis of knob 45 and is positioned between, and to be engageable with, a lower rear wall 43*b* and a lower forward wall 43*c* of the axle carrier 40. In this way rotation of the control knob 45 in the directions indicated by arrows A controls the forward and aft position of the axle 32 and controls its movability to those fore and aft positions indicated by the arrows E in FIGS. 3 and 4.

The front axle 32 has a front roller or wheel 50 mounted on each axle end. Each wheel 50 is molded of plastics material and has a laterally outermost rolling surface 52 to engage the skating surface (e.g. the ground). Laterally inwards of rolling surface 52, each front wheel has a stepped hub 55 providing a laterally innermost surface 54 and an intermediate surface 56 of diameter less than that of rolling surface 52 but greater than that of surface 54. The surface 56 is randomly roughened or provided with a plurality of specific surfacial disturbances, e.g. in the form of surface knurling, ribs, or (as is preferred) axially directed narrow and wide grooves 57. These grooves 57 provide a good frictional reaction when, to effect wheel braking, the wheel surfaces 56 are brought into contact with the arcuate surfaces 26 of the positionally fixed braking pad 25 (see FIG. 3).

The laterally innermost surface 54 of each front wheel 50 is provided with a plurality of axially directed slots or notches 58—preferably, in this embodiment, staggered radially from the grooves 57 of braking surface 56. The notches 58 are for engagement by motion lock means 60 (see FIG. 3) provided on each side wall of housing 34. The motion lock means 60 comprises a pair of arcuately spaced pins or dog teeth 62 directed laterally outwards of each housing wall 33, these dog teeth 62 being fittingly engageable into two of the wheel notches 58 when axle 32 is moved rearwardly to bring the wheel 50 into engagement of the wheel surface 54 and its notches 58.

Figure 6:
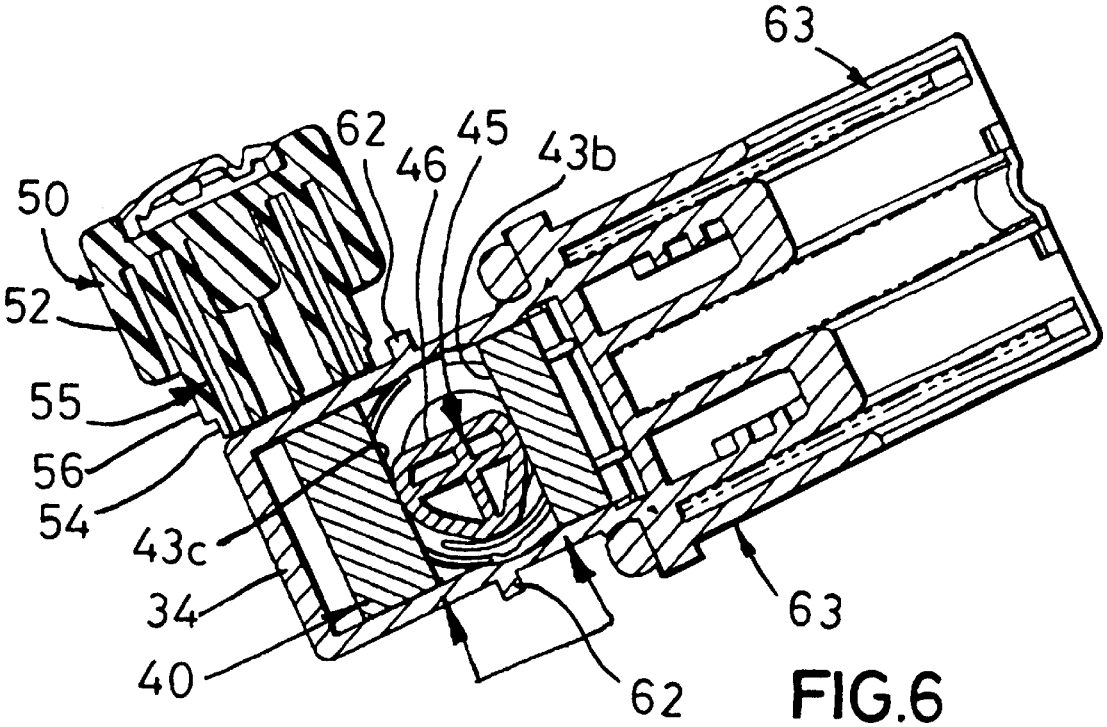
FIG. 6 is a cross-sectional view on the line V—V of FIG. 5 in a first relative position of parts shown therein.

With the control knob 45 in a first rotary position (A), the cam member 46 is positioned as shown in FIG. 6 and fully occupies the space between walls 43*b* and 43*c* so as to provide zero clearance between them. The degree of offset of the eccentric cam is such that, in this position for the control knob 45, the front axle 32 is held, on each skate side, in a fixed position midway between the two semi-circular ends of slot 35. In this fixed or locked axle position, the two wheels 50 at the axle ends are free of engagement both of the brake pad's arcuate frictional surface 26 and of the dog teeth 62. Thus the roller skate can be used for both forward and rearward skating.

Figure 7:
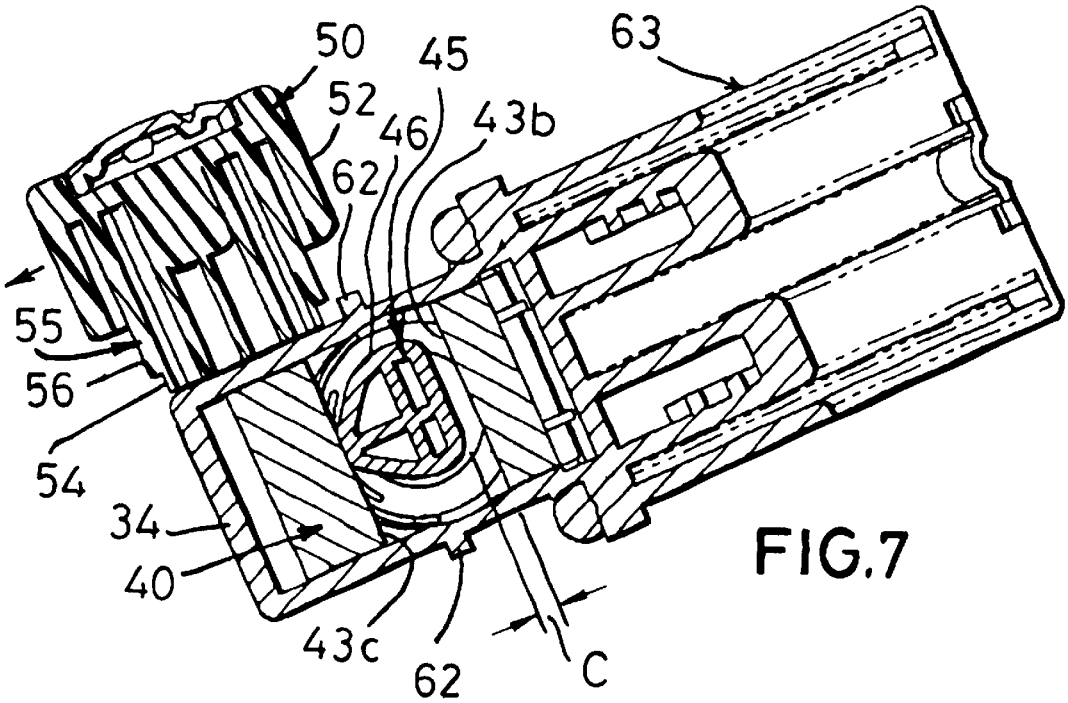
FIG. 7 is a cross-sectional view on the line V—V of FIG. 5 in a second relative position of parts shown therein.

With the control knob 45 in a second rotary position (B), the cam member 46 is positioned as shown in FIG. 7 in which the axle carrier 40 can float freely or move forwardly and rearwardly by a limited clearance C (e.g. of approximately 2 or 3 mm) defined by the distance between walls 43*b* and 43*c* minus the distance across the cam 46 (in this position) through the axis of the control knob 45.

Normally, with the cam 46 in the position of FIG. 7 and during forwards skating motion, the forwards rolling motion of wheels 50 urges the front wheels rearwardly to bring the axle carrier's lower rear wall 43*c* into engagement of the cam 46 so that all of the clearance C is located forwardly of the cam, i.e. between it and the wall 43*b*. However, if—with the cam in this same position—the skater attempts to skate backwards, the reverse rolling motion of wheels 50 automatically urges the front wheels 50 and axle 32 forwardly of the skate and moves the axle carrier 40 in a forwards direction. Such forwards motion—which is permitted by the elongate slots 35 in side walls 33 of housing 34—continues until the braking surfaces of the two front wheels 50 engage against surfaces 26 defined by the two arcuate overhanging wings of braking pad 25. It is the frictional engagement between surfaces 26,56 that inhibits rearward skating, and it will be appreciated that such engagement is automatically induced immediately upon commencement of any rearwards skating.

To assist in frictional engagement, the arcuate surface 26 on each skate side may be provided with a pair of laterally directed ribs 67 (FIG. 3) that tend to engage positively into two of the grooves 57 providing the frictional surfacial disturbances for surface 56. Furthermore, the arcuate surface 26 is positioned to be forwardly and upwardly eccentric with respect to the axis of axle 32 (in its forward position) such as to tend to lock the surface 56 into the narrowing space between it and the surface 26.

With the control knob 45 in the third rotary-position (C), the cam member 46 is positioned as shown in FIG. 8 and again fully occupies the space between walls 43*b* and 43*c* so as to provide zero clearance between them. However in this knob position, the distance from wall 43*b* to the rotational axis of knob 45 is less than in the first rotary position (A) of FIG. 6. Accordingly, the axle carrier 40 is pulled rearwardly to a position in which two notches 58 in the surface 54 of each wheel 50 come into interfitting "dog clutch"engagement of the two teeth 62 provided on the associated side wall 33 of housing 34. In this positively engaged condition, rotary motion of the front wheels 50 is prevented in each rotational direction so that skating motion is inhibited both in a forwards direction and in a rearwards direction.

The rotary knob 45 is easy to operate (and is considered easier to use than a click-stopped adjusting slide of the prior art). In addition, its camming action controls the relative position of the wheels 50 such that the condition of forwards only motion of the skate, (i.e. inhibited rearwards motion) is without any ratcheting or like noise.

The skate length adjusting means 13 comprises a beam 63 of generally rectangular cross-section (see also FIGS. 9–13) that is telescopically slidable in a bore 73 of mating rectangular cross-section molded in a rear shoe part 74 of the rear carriage 12, and the two telescoping parts 63,73 are locked in any desired one of a plurality of relative positions by a lock member 70. The beam is integral with, and extends rearwardly of, the front shoe part 14 of front carriage 11. The beam 63 has a planar top surface 64 and, perpendicular thereto, two outer side walls 66. The latter have planar exterior surfaces but inner surfaces that are provided with a plurality of inwardly facing, vertically directed ribs 68 that define open-ended vertical slots or channels 65. Advantageously, as shown, the ribs 68 are equi-spaced longitudinally of the beam 63 and define equi-spaced vertical slots or channels 65. The beam 63 is molded additionally to provide, on its underside, an integral elongate reinforcing element 69 of generally rectangular cross-section, the sides 61 of element 69 being parallel to and spaced from the bight surfaces of the vertical slots or channels 65.

Figures 9, 10:
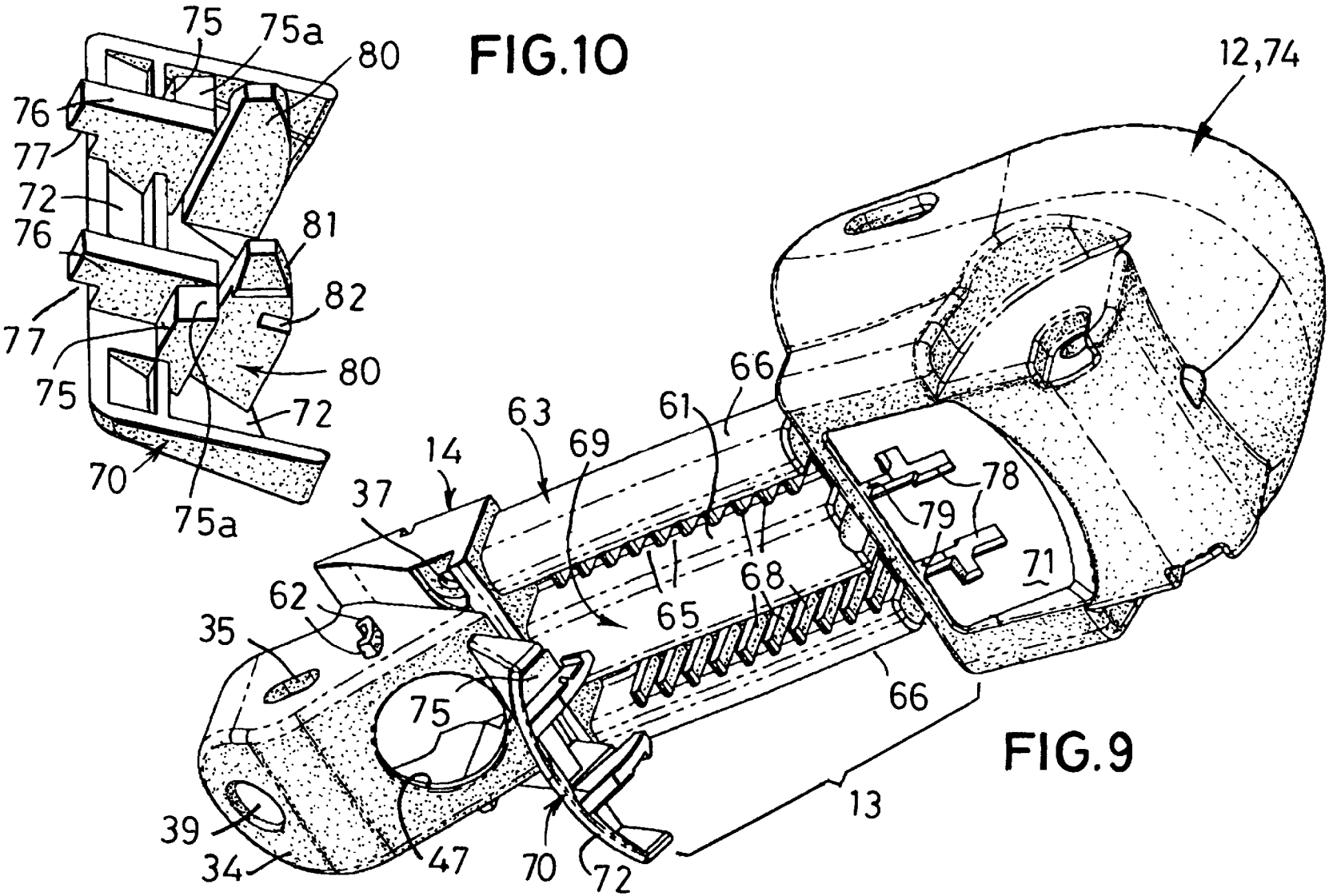
FIG. 9 is a perspective view of the underside of parts of both the front and rear of the skate (with some parts omitted for clarity of illustration)
FIG. 10 is a perspective view from above of a lock member shown in FIG. 9.
Figure 11:
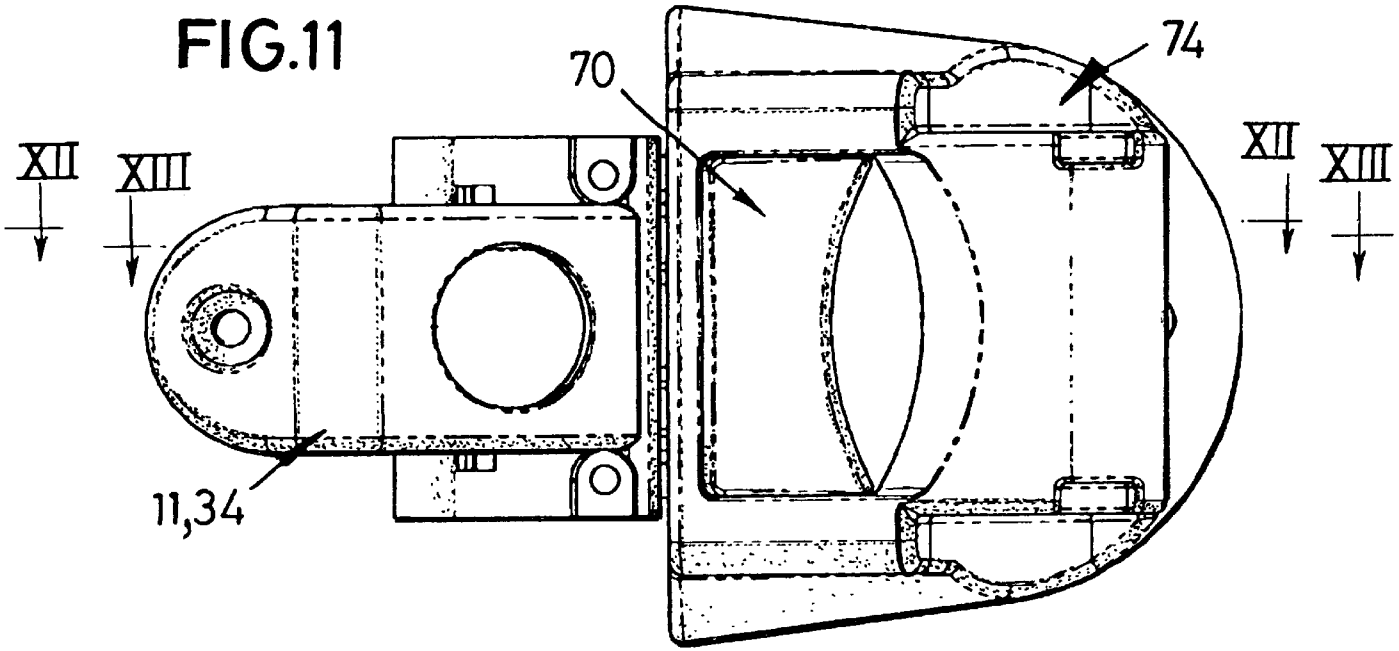
FIG. 11 is an underneath plan view of the parts shown in FIG. 9.
Figure 21:
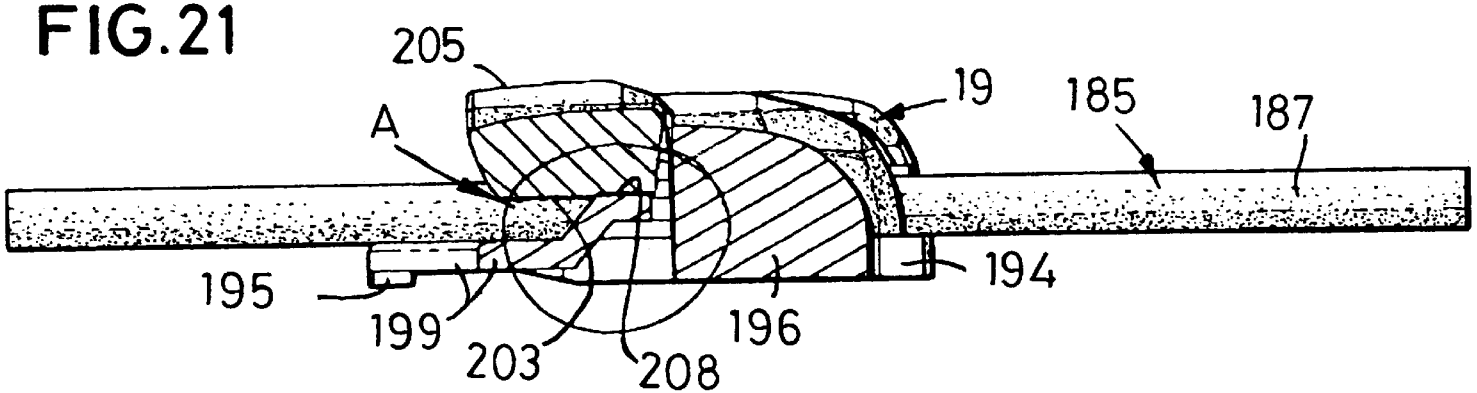
FIG. 21 is a cross-sectional view on the XXI—XXI of FIG. 19.

The lock member 70 is molded of plastics material to provide a bowed plate 72 integral with a pair of locking limbs 75 that extend away from the concave side of bowed plate 72, a similarly extending pair of longer, part-arcuate, retainer limbs 80, and with a pair of rearwardly directed limbs 76 having an undercut notch 77 (FIG. 10). A pair of elongate openings 78 (FIG. 9) are provided in the bottom wall 71 of the rear shoe part 74. The two pairs of limbs 75,80 of the lock member 70 can extend through the openings 78 to project into the bore 73 as the lock member 70 is pivoted about an axis defined by the engagement of each undercut notch 77 with a forward end 79 of its associated opening 78.

Figure 12:
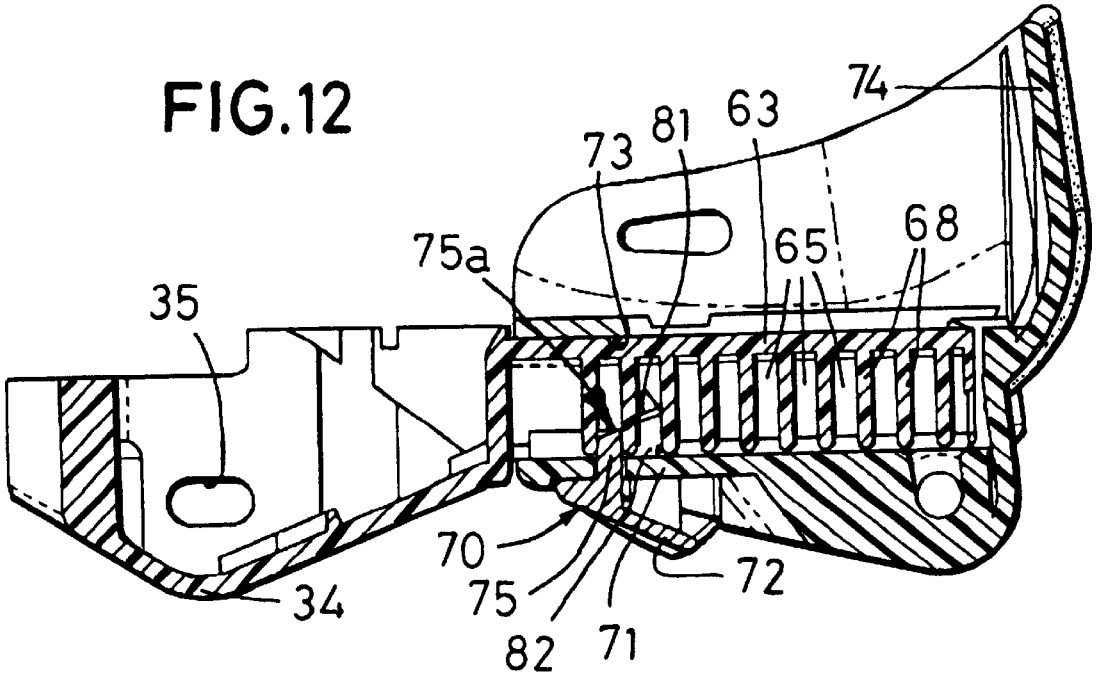
FIG. 12 is a cross-sectional view on the line XII—XII of FIG. 11.
Figure 13:
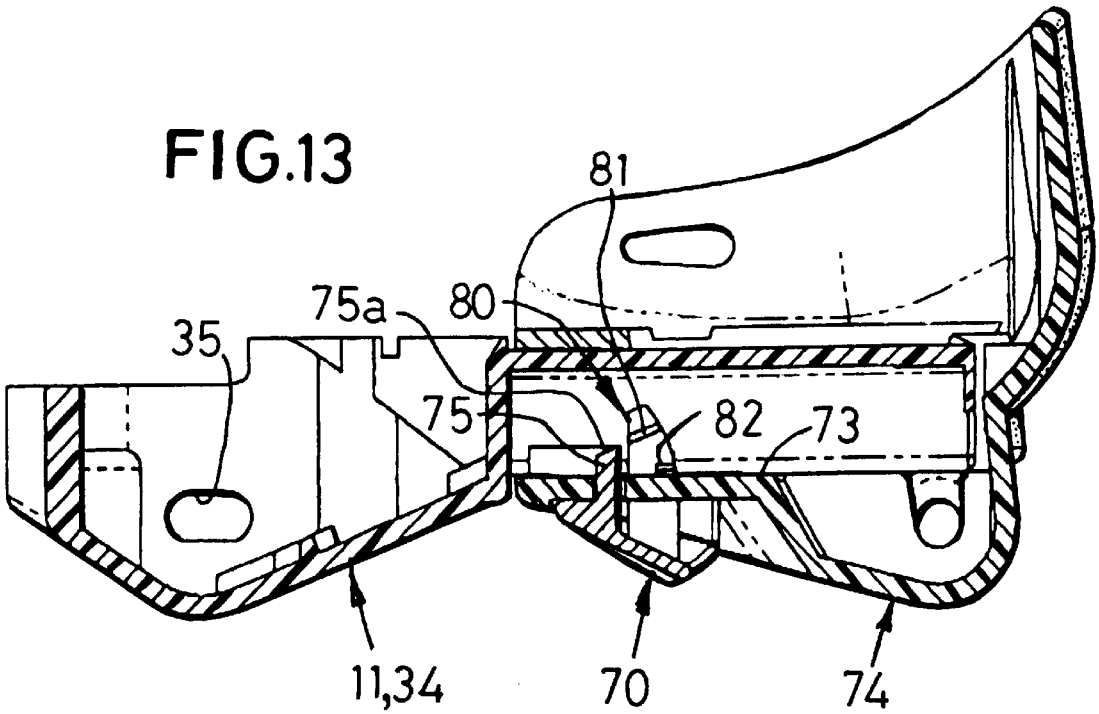
FIG. 13 is a cross-sectional view on the line XIII—XIII of FIG. 11.
Figure 14:
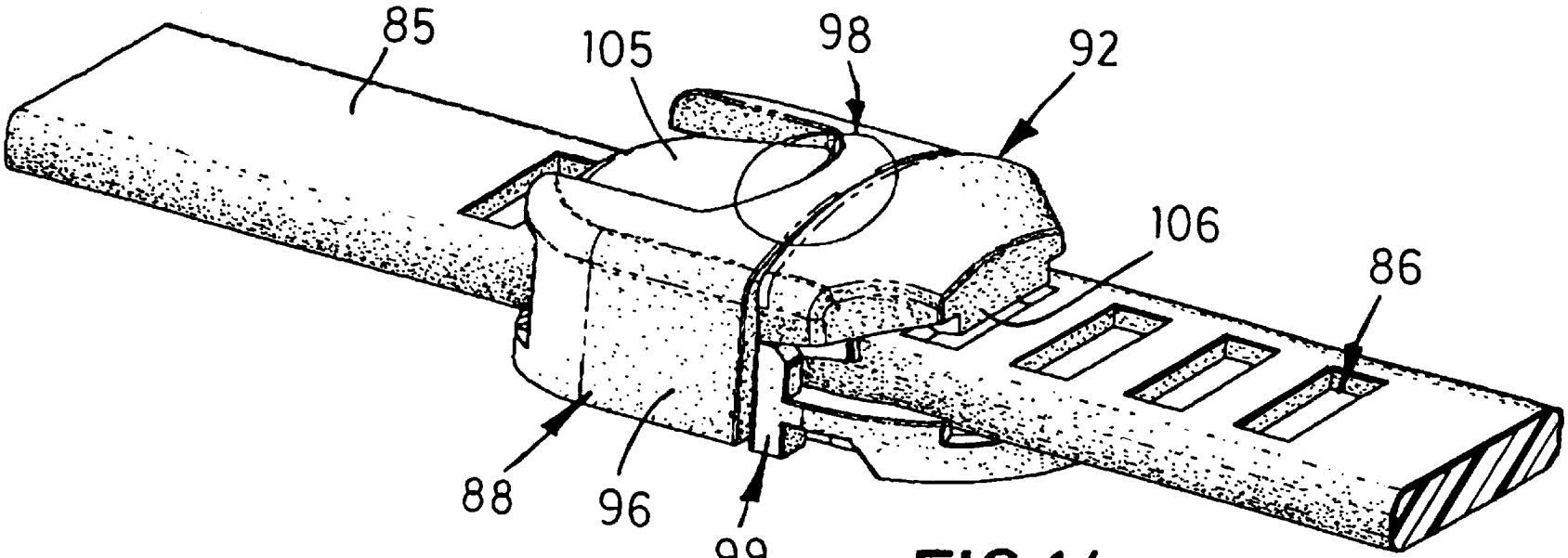
FIG. 14 is a perspective view of a fastening arrangement (strap and buckle) inter alia for the skate of FIG. 1.
Figure 15:
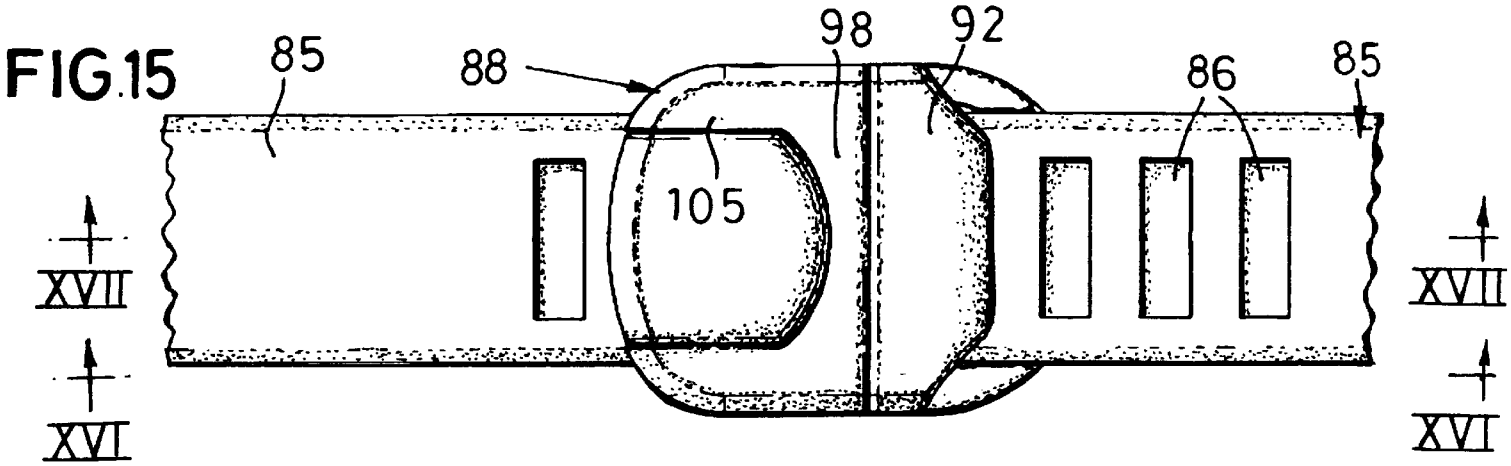
FIG. 15 is a plan view of the fastening arrangement of FIG. 14.
Figure 16:
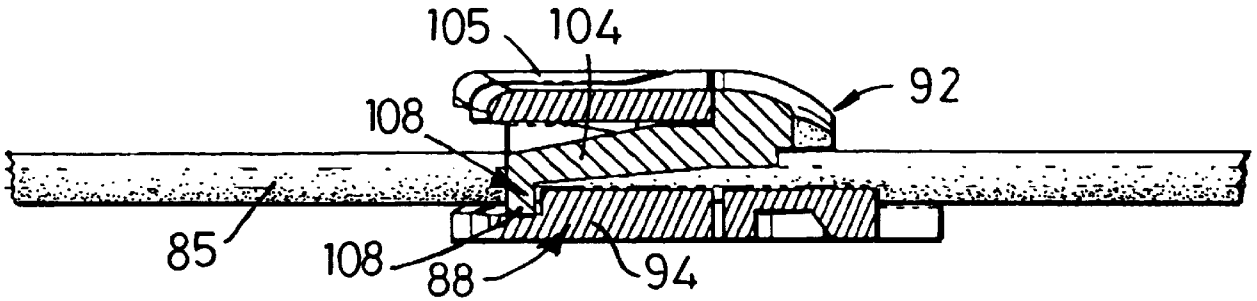
FIG. 16 is a cross-sectional view on the line XVI—XVI of FIG. 15.
Figure 17:
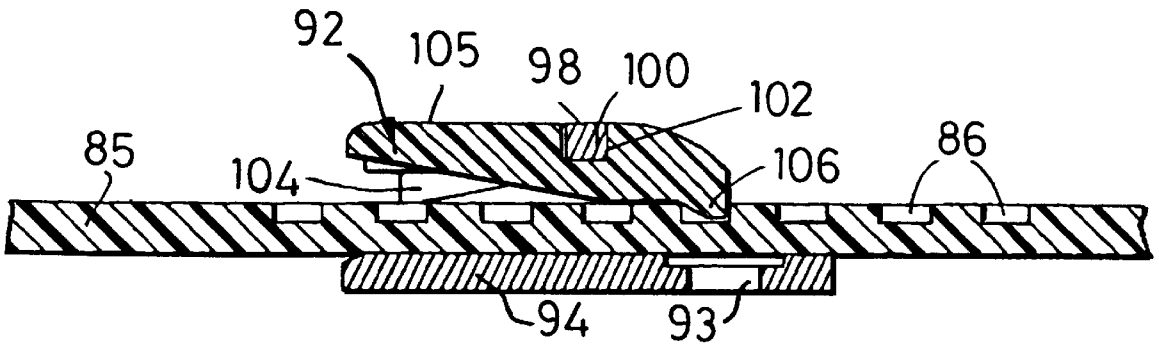
FIG. 17 is a cross-sectional view on the line VXII—XVII of FIG. 15
Figure 18:
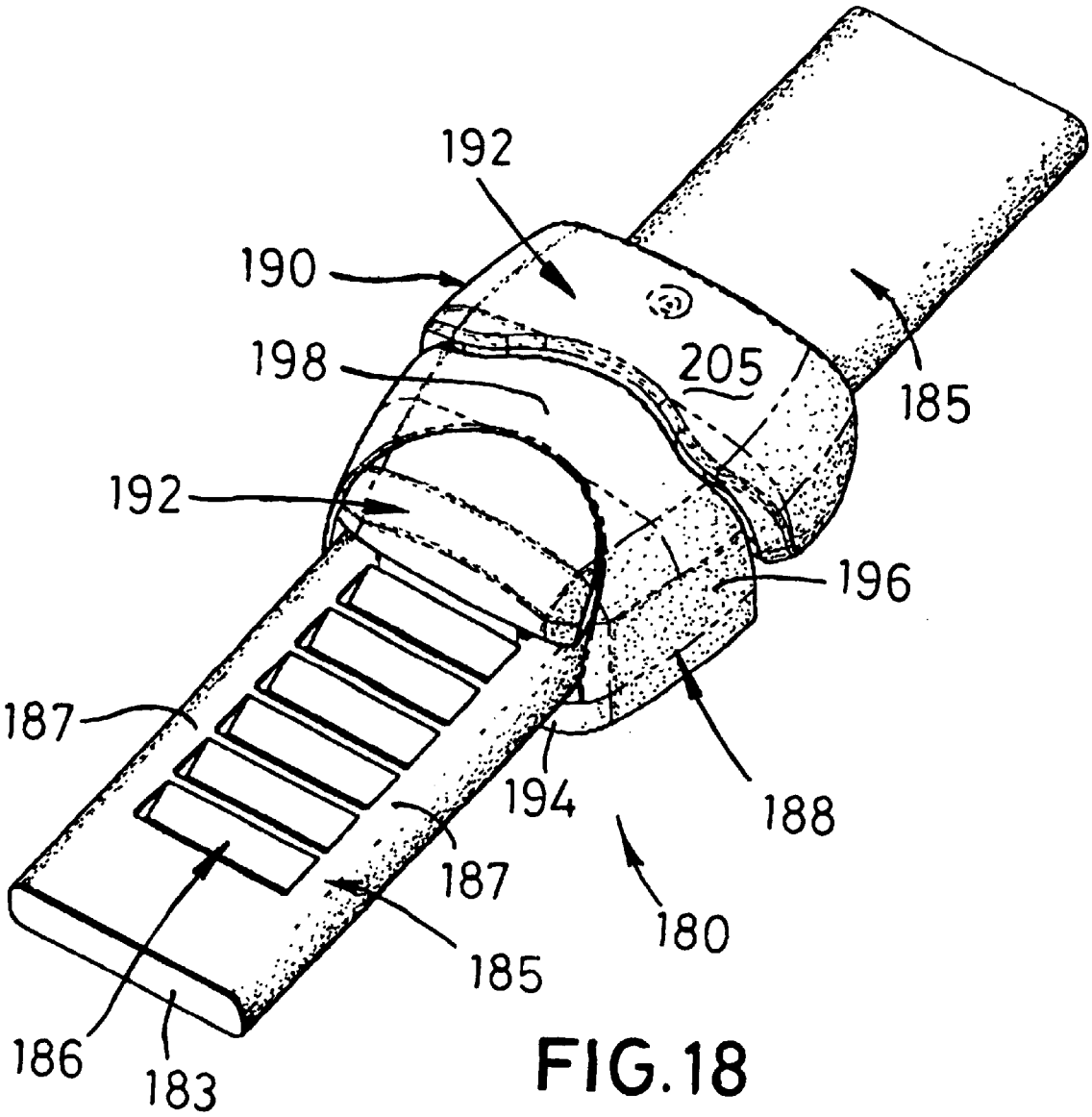
FIG. 18 is a perspective view of another strap and buckle fastening arrangement inter alia for the skate of FIG. 1.
Figure 19:
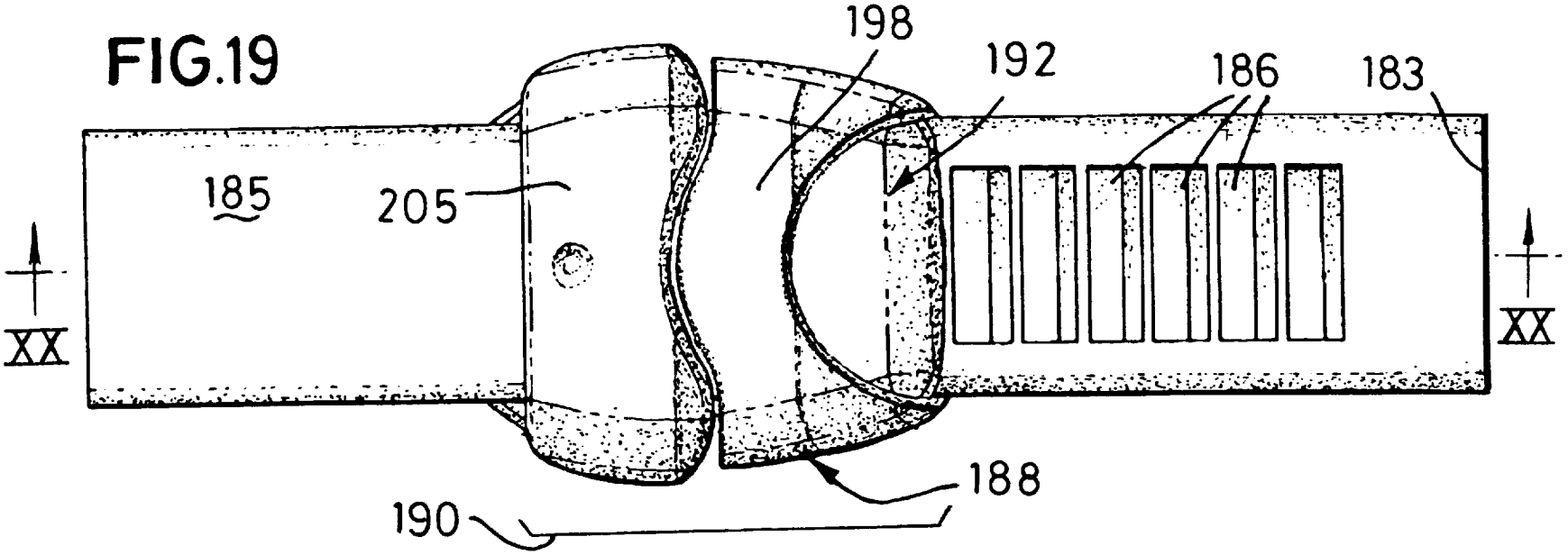
FIG. 19 is a plan view of the fastening arrangement of FIG. 18.
Figure 20:
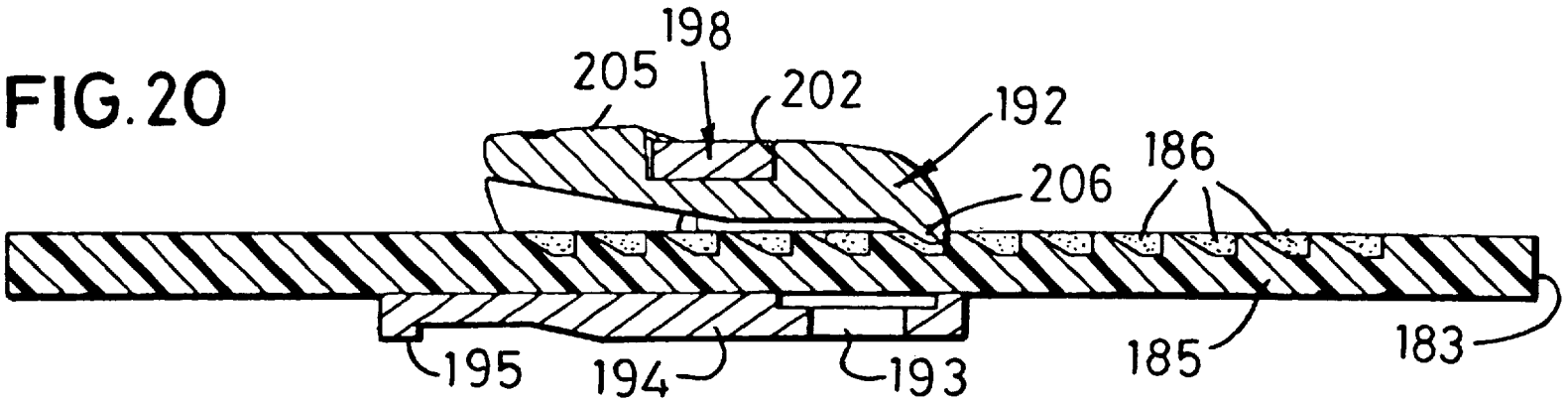
FIG. 20 is a cross-sectional view on the line XX—XX of FIG. 19.

The locking limbs 75 are of generally rectangular cross-section and dimensioned to fit snugly into a selected slot or channel 65 in the beam 63 (see FIG. 12). The transverse end surface 75*a* of each limb 75 is inclined such that it can slide over, and/or displace slightly, a rib 68 in the event that the slot 65 is not fully aligned with the path of movement of the limb 75. This inclined end surface 75*a* not only serves to provide a chamfered lead into the selected slot or channel 65, but also provides a clearance (when the lock member 70 is pivoted to the open position) for the beam 63 to move longitudinally of the bore 73 during skate length adjustment.

The retainer limbs 80 serve to retain the lock member 70 to the rear shoe part 74 and limit its pivotal motion about the pivot provided by inter-engaged features 77,79. To this end each limb 80 is provided with an end tab or barb 81 directed laterally outwards, and with a similarly directed (but to a lesser extent) intermediate tab or barb 82.

When, with the beam 63 of front carriage 11 fully withdrawn or removed from bore 73, the lock member 70 is initially fitted pivotally (via interengaged features 77,79 as already described) to the rear carriage 12, the retainer limbs 80 flex resiliently in a laterally inwards direction to permit each of the barbs 81,82 to pass through openings 78 and snap back behind the bottom wall 71 of the rear shoe part 74. The retainer limbs 80 thereby occupy the space between the beam-integral reinforcing element 69 and the facing vertical edges of the slot-defining ribs 68, and the planar inner surfaces of the retainer limbs 80 thereby fit snugly and slidingly against the side surfaces 61 of the reinforcing element 69.

When the beam 63 is then slid into the rear shoe part's bore 73, the limbs 80 extending from bowed plate 72 adopt a position in which they bestride (snuggly and fittingly) the reinforcing element 69 which then prevents the free ends of the retainer limbs 80 from flexing inwards. The reinforcing element 69 thus prevents the tabs or barbs 81 on limbs 80 from being pulled out through the elongate openings 78 when the bowed plate 72 is pivoted away from bottom wall 71, e.g. to adjust the skate's overall length. In other words the co-operable parts 69,80 and 81 serve to retain the manually operable lock member 70 pivotably movable with respect to the skate but nevertheless held against full removal therefrom.

However, since the lateral extent of the tabs or barbs 82 is less than the lateral extent of the tabs or barbs 81, the tabs or barbs 82 can still snap past the bounding edge of each elongate opening 78 as the lock member 70 is pivoted towards or away from the bottom wall 71 of rear shoe part 74. It will be appreciated that when lock member 70 is pivoted towards the bottom wall 71, the tabs or barbs 82 snap through to lie immediately behind the wall 71 and thus serve to resist return opening (i.e. pivoting away from wall 71) of lock member 70. These tabs or barbs 82 of lock member 70 thus serve to retain the locking limbs 75 in engaged condition with the selected pair (one to each side of the skate) of the slots or channels 65 (see FIGS. 12, 13). It will also be appreciated that when the lock member 70 is forcibly pivoted away from bottom wall 71, the tabs or barbs 82 are forcibly pulled (in snap-like fashion) through the openings 78 and the locking limbs 75 are simultaneously withdrawn out from their engagement of the slots or channels 65. The overall length of the skate can then be varied to that desired and can then be locked in the (revised) adjusted position by returning the locking member 70 to its closed position, i.e. pivoting it back towards the bottom wall 71 and forcing the barbs 82 back through the openings 78.

As best seen in FIG. 2, the rear skate carriage 12 comprises rear shoe part 74 with a flexible boot 73 therein held to the shoe part 74 by a tread plate 83 attached thereto by screws 84.

The illustrated roller skate 10 also comprises a strap and buckle arrangement (FIGS. 14–17) to provide a fastening for the skate around the front of a user's ankle. The arrangements's strap 85 is molded of plastics material integral with one side of the rear shoe part 74 and such as to provide its upper surface with a plurality of recesses 86 of uniform rectangular cross-section (with their longer side length transverse to the longitudinal extent of the strap 85). The arrangement's buckle 90—with which the strap 85 co-operates—is attached to the other side of the rear shoe part 74.

The buckle 90 comprises two separate parts 88 and 92. Part 88 is a housing molded of plastics material to provide a bottom wall 94, two side walls 96, and a top wall 98 (the opposed ends of housing 88 being open for the strap 85 to pass through). Part 92 is a plastics-molded pawl member located for pivotal motion within housing 88.

The housing 88 is fastened, e.g. by a rivet 91 through a hole 93 in bottom wall 94 (FIG. 1), to an upper lobe-like extension of said other side of the rear shoe part 74. The bottom wall 94 may have a slightly concave outer face to facilitate its pivotal movement about the fastener's axis. The internal face of bottom wall 94 is integrally provided with a pair of upstanding resilient limbs 99 that serve to permit the snap-fitted insertion of pawl member 92 longitudinally into the housing 88 from one of its open ends, and restrain its subsequent removal. The top wall 98 of housing 88 is of substantially smaller dimension than the bottom wall 94, and is provided internally with a transverse rib 100 of generally rectangular cross-section.

This rib 100 sits within a channel-like groove 102 in the pawl member 92, the groove 102 being of similar rectangular cross-section—preferably of marginally greater width than the width of rib 100. The co-operation between rib 100 and groove 102 defines a pivotal axis for the pawl member 92—even although there is no specific axle for such pivoting motion.

The pawl member 92 is molded of plastics material integrally with a depending tip 106 to engage a selected recess 86 of the strap 85, and also with a pair of outwardly splayed side wings 104 (FIG. 16) that are provided with short, downwardly directed fingers 108 at the free ends of the wings. With the pawl member 92 snap-fit inserted into housing 88, the fingers 108 engage the housing's bottom wall 94 and they (plus the wings 104) support the pawl member in position with its top groove 102 accommodating the housing's integral rib 100.

These wings 104 are inherently resilient and, when a user manually presses down the smooth, upper operating surface 105 of pawl member 92 (located to the opposite side of rib 100 to the pawl tip 106), the pawl member 92 executes a pivot-like motion about the interengaged rectangular-section features 100,102 (see FIG. 17) and its tip 106 rises and disengages from engaged strap recess 86—such motion being against the restoring force provided by the resilient wings 104 provided integrally with the pawl member 92. It will be appreciated that the production and assembly of such a two-part buckle (having no separate axle and no separate restoring spring) is very economical.

In an alternative arrangement the illustrated roller skate 10 may comprise the somewhat different strap and buckle fastening arrangement 180 of FIGS. 18–25 to provide a fastening for the skate around the front of a user's ankle. The fastening arrangement 180 likewise provides a quick-release, length-adjustable fastening arrangement comprising a strap 185 and a two-part buckle 190.

The arrangement's strap 185 is molded of plastics material integral with or otherwise attached to one of the two parts to be fastened together. The upper surface of strap 185 is molded—at least adjacent its leading end 183—with a plurality of recesses 186 each extending laterally of the strap and each of uniform flat-bottomed trapezium-shaped cross-section. The length of each recess 186 (directed transversely of the strap) is less than the strap's width so as to leave to each side of the strap a non-recessed flat-surfaced selvedge 187.

The arrangement's buckle 190—with which the strap 185 co-operates—comprises two separate parts 188 and 192. Part 188 is a housing molded of plastics material to provide a bottom wall 194, two side walls 196, and a top wall 198 (the opposed ends of housing 188 being open for the strap 185 to pass through). Part 192 is a separate pawl member located for rocking or pivotal motion within housing 188.

The housing 188 has a hole 93 in its bottom wall 194 and a rivet (not shown) through hole 193 pivotably attaches the housing 188 of buckle 190 to the other of the two parts that are to be releasably fastened to one another by the fastening arrangement 180. The housing's bottom wall 194 may have a slightly concave outer face to facilitate its pivotal movement about the rivet's axis, and may be molded with a depending protuberance 195 to provide a reaction point against forces tending to uncouple the fastening.

In addition, this bottom wall 194 is integrally provided with a pair of upstanding resilient limbs 199 that serve to permit the snap-fitted insertion of pawl member 192 longitudinally into the housing 188 from one of its open ends, and restrain its subsequent removal. These resilient limbs 199 also provide a restoring force on the pawl member 192 when the latter is manually depressed and urged out of its latching engagement of a recess 186 of strap 185.

The top wall 198 of housing 188 is of substantially smaller dimension than the bottom wall 194, and is of generally arcuate form, this arrangement limiting strains within the plastics material molding and providing for a more robust structure. This top wall 198 sits within a channel-like groove 202 in the pawl member 192, the groove 202 being of similar arcuate form—preferably of marginally greater width than the width of top wall 198 (see FIGS. 9 and 10). The co-operation between top wall 198 and groove 202 defines a pivotal or rocking 'axis' for the pawl member 192—even although there is no specific axle for such pivoting or rocking motion.

Figure 8:
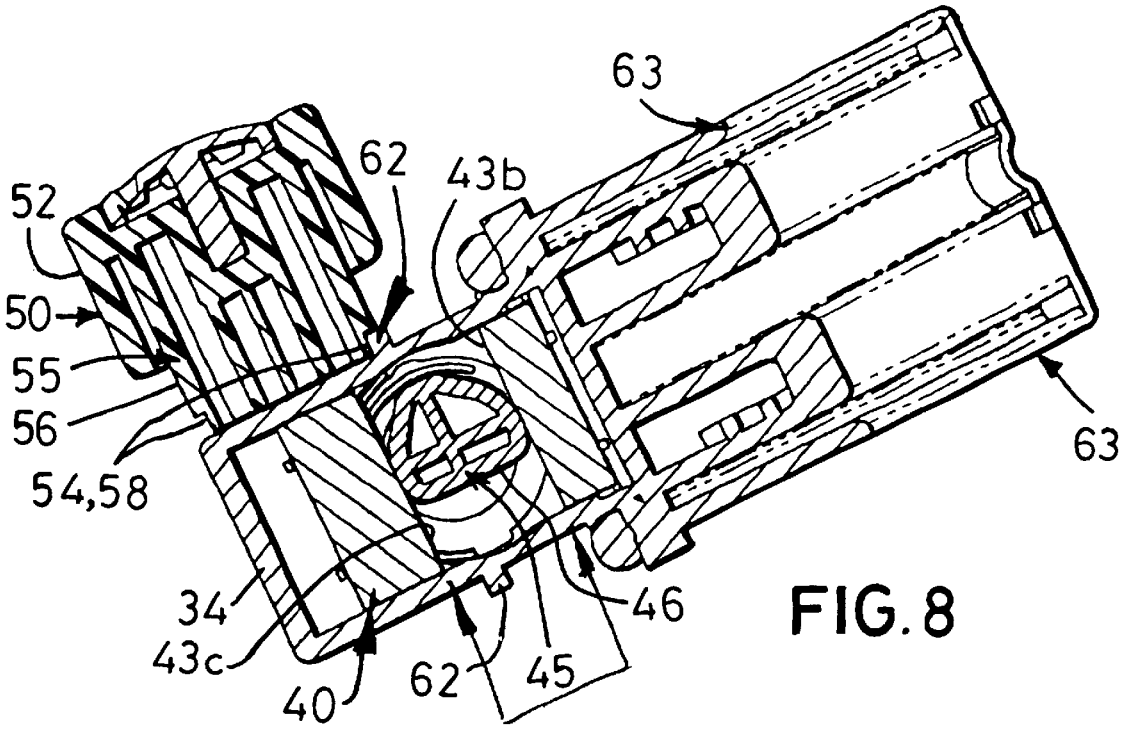
FIG. 8 is a cross-sectional view on the line V—V of FIG. 5 in a third relative position of parts shown therein.

The pawl member 192 is molded of plastics material integrally with a depending tip 206 to engage a selected recess 186 of the strap 185, and also with a pair of downwardly directed side limbs 204 each provided internally with a step or shoulder 203 (FIG. 11) for abutting engagement of a horizontally directed tab-like finger 208 at the free end of each limb 199 of the buckle's housing part 188 (see encircled portion 'A' in FIG. 8). With the pawl member 192 snap-fit inserted into housing 188 with its top groove 202 accommodating the housing's top wall 198 and with its side limbs 204 encompassing and guiding the side edges of the strap 185 (when the latter is inserted into the buckle), the fingers 208 engage the steps or shoulders 203 such that they act as stops to rocking movement of the pawl member 192 and prevent it trapping the strap 185.

Furthermore, as indicated above, the limbs 199 are inherently resilient and, when a user manually presses down the substantially smooth, upper operating surface 205 of pawl member 192 (located to the opposite side of top wall 198 to the pawl tip 206), the pawl member 192 executes a pivot-like motion about the interengaged projection-and-channel features 198,202 (see FIG. 7) and its tip 206 rises and disengages from the engaged strap recess 186. This motion is against the restoring force provided by the resilient limbs 199 which are molded integrally with the housing part 188. The inter-relationship between these resilient limbs 199, the inclined interior face of the housing part 188 and the pawl member 192 is such that the pawl member 192 is correctly held in a generally flat attitude within the housing part 188, the limbs 199 holding the pawl member 192 within the housing part 188 both when the strap 185 extends through the housing part 188 and when that strap is absent.

It will be appreciated that the production and assembly of a two-part buckle 90 or 190 (having no separate axle and no separate restoring spring) is very economical.

It will further be appreciated that the fastening arrangement 80 (of strap 85 and buckle 90) and the fastening arrangement 180 (of strap 185 and buckle 190) can each be provided otherwise than as described above. It may be provided to hold a person's ankle in a different footwear article, for example a different training two-axle roller skate, a conventional two-axle roller skate or a training or conventional in-line roller skate, or at the toe of a skate (e.g. to replace cross-over band 18, where it and toe cap 20 are omitted), or as part of some other footwear article (e.g. to provide for adjustable width, say, on an article of orthopaedic footwear). Indeed, it is considered that a fastening arrangement such as 80 or 180 might be applied to many situations (including non-footwear articles) where a conventional buckle and strap fastening is required or has hitherto been employed.

It will thus be appreciated that the present invention is not limited to the particular embodiments illustrated and that other modifications and embodiments of the invention, which will be readily apparent to those skilled in the art, are to be deemed within the ambit and scope of the invention. For example, the housing 88 or 188 may be attached in a fixed, non-pivotal manner, to the part to which the strap 85 or 185 is to be releasably fastened. Alternatively, the buckle 90 or 190 may be provided at one end of the strap 85 or 185, remote from the end having recesses 86 or 186 to be engaged by the buckle's pawl member, so that the strap and its attached buckle can be used as a free-standing wrap-around binding. Alternatively or additionally the recesses 86 in the strap 85 may alternatively be of saw-tooth or trapezoidal cross-section (rather than the uniform rectangular cross-section illustrated).

The skate itself may also be varied (without departing from the scope and ambit of the invention). For example, the dog teeth 62 of the skate may be replaced by a frictional pad to inhibit forward (and rearward) skate motion.

It will thus be appreciated that the particular embodiment (s) hereinbefore described may be varied in construction and detail, e.g. interchanging (where appropriate or desired) different features of each, without departing from the scope of the patent monopoly claimed.

What is claimed is:

1. A training roller skate comprising rollers or wheels and mounting means therefor, and further comprising motion inhibiting means for contacting a surface associated with at least one of said wheels to inhibit its rotary motion, characterised in that the mounting means for said one wheel is movable to permit contact between said wheel associated surface and the motion inhibiting means, and wherein said mounting means is operably associated with setting means selectively settable to a first positional setting and a second positional setting, wherein setting of the setting means in said first positional setting constrains said mounting means to a first position out of said contact and wherein setting of the setting means in said second positional setting permits said contact to occur in use automatically upon a user's attempt to skate backward.

2. A training roller skate according to claim 1 wherein said mounting means is movable in a direction transverse to the wheel axis.

3. A training roller skate according to claim 1 wherein said setting means is addittionally settable to a third positional setting in which rotation of the wheels inhibited in both direction such as to inhibit both forwards skating and rearwards skating.

4. A training roller skate according to claim 1 wherein a platform is provided to support a skater's foot, said mounting means includes a carrier member carrying an axle upon which said one wheel is mounted, and the skate comprises means mounting the carrier member for relative movement with respect to the platform.

5. A training roller skate according to claim 1 and further comprising:

a front shoe part defining a forward platform portion to support a skater's foot and further defining toe cap support means; and a separately formed toe cap attached to said toe cap support means.

6. A training roller skate according to claim 1 including a platform to support a skater's foot, at least one roller mounted movably with respect to the platform, and a brake pad of frictional material attached to said platform and engageable by said roller, said brake pad being provided integrally with a projection frictionally to engage the skating surface when the platform is tilted.

7. A training roller skate according to claim 1, the skate comprising a main body, rollers or wheels and mounting means therefor, wherein at least one of said wheels has a surface associated therewith provided with at least one projection or recess, said body is provided with at least one recess or projection dimensioned for mating engagement with at least one of the said surface projection or recess, and wherein the mounting means for said at least one wheel is movable selectively to effect such mating engagement—to inhibit both forwards skating and rearwards skating—and out of such mating engagement—to permit skating in at least the forwards direction.

8. A training roller skate according to claim 1 and comprising:

a forward carriage and a rearward carriage, length adjustment means interconnecting the first and second carriages; and locking means to lock the interconnected first and second carriages in a selected one of a plurality of predetermined relative positions;

wherein the locking means comprises, to each side (of the skate's longitudinal central axis):

an elongate channel having one said wall thereof formed with a plurality of slot openings depending from one of said carriages; and a lock member mounted for pivoting motion on the other of said carriages, said lock member having a first finger to extend through an opening in a wall of said other carriage and abut against the opposite wall of said recess, and having a second finger to extend through the same or another opening in said carriage wall and to engage into a selected one of the slot openings.

9. A training roller skate according to claim 1 incorporating a fastening arrangement comprising:

a strap having (preferably between edges of the strap) a plurality of recesses in a major surface of the strap; and a buckle having a body member in the form of an arched structure through which the strap is to extend and further having a pawl member disposed between said major surface of the strap—when the latter is in the buckle—and a facing wall of the body member, said pawl member having a tip end for entry into any selected one of said recesses, characterised in that one of said members is provided with a laterally-extending element (e.g. a rib or a wall), and the other of said members is provided with a laterally-extending channel to accommodate the element and define therewith a pivot axis for the pawl member.

10. A training roller skate according to claim 1 incorporating a fastening arrangement comprising:

a strap and a buckle releasably engageable with the strap, wherein the strap has a major surface provided with a plurality of recesses therein and the buckle comprises a pawl member mounted on a body member—through which passes the strap to be fastened—and such as to be movable into and out of an engaged state in which the pawl member is in selective engagement of one or more individual recesses, wherein one of said members is molded of plastics material integrally with at least one inherently resilient limb that is engageable of the other of said members to provide a restoring force countering disengagement of the pawl member from its said state of recess engagement.

11. A training roller skate according to claim 3 comprising first and second motion inhibition means, the first motion inhibition means being engageable by said wheel associated surface when the setting means occupies said second position, and the second motion inhibition means being engageable by at least one wheel surface when the setting means occupies said third position.

12. A training roller skate according to claim 4 wherein said mounting means mount the carrier member for relative movement with respect to the platform in a direction transverse to the axis of said axle.

13. A training roller skate according to claim 4 wherein the setting means includes a rotatably mounted control element having an eccentric cam member engageble with a part of said carrier member such as to position and/or effect location of the axle carrying carrier member as aforesaid.

14. A training roller skate according to claim 5 wherein inter-engageable snap-fit means are associated with the toe cap and the toe cap support means to permit their mutual attachment in a snap-fitted manner.

15. A training roller skate according to claim 6 wherein the brake pad, when engaged by said roller, serves to inhibit rearward motion of the skate.

16. A training roller skate according to claim 11 wherein the first motion inhibition means comprises a pad of frictional material.

17. A training roller skate according to claim 11 wherein a platform is provided to support a skater's foot, said mounting means includes a carrier member carrying an axle upon which the said at least one wheel is mounted, the skate comprises means mounting the carrier member for relative movement with respect to the platform, and wherein the setting means is operable on the carrier member to position the axle, in said third position, for engagement of said at least one surface by the second motion inhibition means only.

18. A training roller skate according to claim 11 wherein a platform is provided to support a skater's foot, said mounting means includes a carrier member carrying an axle upon which said one wheel is mounted, the skate comprises means mounting the carrier member for relative movement with respect to the platform, and wherein the-setting means is operable on the carrier member to position the axle, in said third position, for engagement of said at least one surface by both the first and second motion inhibition means.

19. A training roller skate according to claim 17 wherein the pad has an arcuate surface engageable by said wheel associated surface.

20. A training roller skate according to claim 17 wherein the pad comprises an integral projection directed forwardly of the skate to provide a toe brake" that can engage the skating surface when in use the skate is tilted.

21. A training roller skate according to claim 18 wherein said second motion inhibition means comprises a dog tooth clutch arrangement comprising a positionally fixed tooth engageable in one of a plurality of slots provided in the outer surface of a hub of one said wheel.

22. A training roller skate according to claim 19 wherein the second motion inhibition means comprises a friction pad.

23. A training roller skate according to claim 21 wherein a pair of such dog teeth are provided, one to each side of the trainer roller skates, to be engageable as aforesaid with a hub of each said wheel.

24. A roller skate comprising:

a forward carriage and a rearward carriage, length adjustment means interconnecting the first and second carriages; and locking means to lock the interconnected first and second carriages in a selected one of a plurality of predetermined relative positions;

wherein the locking means comprises, to each side of the skates's longitudinal central axis:

an elongate channel having one side wall thereof formed with a plurality of slot openings depending from one of said carriages; and a lock member mounted for pivoting motion on the other of said carriages, said lock member having a first finger to extend through an opening in a bottom wall of said other carriage and abut against an opposite side wall of said channel, and having a second finger to extend through the same or another opening in said carriage bottom wall and to engage into a selected one of the slot openings.

25. A training roller skate according to claim 24 incorporating a fastening arrangement comprising:

a strap and a buckle releasably engageable with the strap, wherein the strap has a major surface provided with a plurality of recesses therein and the buckle comprises a pawl member mounted on a body member—through which passes the strap to be fastened—and such as to be movable into and out of an engaged state in which the pawl member is in selective engagement with one or more individual recesses, wherein one of said pawl member and said body member is molded of plastics material integrally with at least one inherently resilient limb that is engageable with the other of said pawl member and said body member to provide a restoring force countering disengagement of the pawl member from its said state of recess engagement.

26. A training roller skate according to claim 24 incorporating a fastening arrangement comprising:

a strap having (preferably between edges of the strap) a plurality of recesses in a major surface of the strap; and a buckle having a body member in the form of an arched structure through which the strap is to extend and further having a pawl member disposed between said major surface of the strap—when the latter is in the buckle—and a facing wall of the body member, said pawl member having a tip end for entry into any selected one of said recesses, characterised in that one of said members is provided with a laterally-extending element (e.g. a rib or a wall), and the other of said members is provided with a laterally-extending channel to accommodate the element and define therewith a pivot axis for the pawl member.

27. A roller skate according to claim 24 wherein the two first fingers are laterally resilient and have laterally directed tabs or barbs to resist passage of the first fingers through the first-mentioned openings.

28. A roller skate according to claim 27 wherein one of said carriages has an elongate beam provided with a pair of upwardly directed surfaces and, when the said carriages are interconnected, the lock member bestrides this pair of surfaces such that the latter resist laterally inward motion of the fingers and their laterally directed tabs or barbs such as to prevent disengagement of the lock members from the said other carriage.

29. A training roller skate apparatus comprising rollers or wheels and mounting means therefor, and further comprising motion inhibiting means for contacting a surface associated with at least one of said wheels to inhibit its rotary motion, characterized in that the mounting means for said one wheel is moveable to permit contact between the wheel associated surface and the motion inhibiting means, and the roller skate further including a front shoe part defining a forward platform portion to support a skater's foot and further defining an enclosure having an inside and an outside and to accommodate, on the inside, a skater's toes; said enclosure comprising toe cap support means having an aperture therein, and the apparatus including a plurality of separately formed toe caps each provided with different decorative indicia, a selected one of said separately formed toe caps being snap-fittingly attached from inside of the enclosure to said toe cap support means such as to extend across and close said aperture in fixed position and without protruding therethrough and thus to present the decorative indicia of said selected one toe cap to be viewed in said aperture when viewed from outside the enclosure.

30. A training roller skate comprising rollers or wheels and mounting means therefor, and further comprising motion inhibiting means for contacting a surface associated with at least one of said wheels to inhibit its rotary motion, the mounting means for said one wheel being movable to prevent contact between the wheel associated surface and the motion inhibiting means, and further comprising:

a forward carriage and a rearward carriage, length adjustment means interconnecting the forward and rearward carriage, locking means for locking the interconnected forward and rearward carriages in a selected one of a plurality of predetermined relative positions, the locking means comprising to each side of a longitudinal central axis of the skate:

an elongate channel having one side wall formed with a plurality of slot openings depending from one of said carriages, and a lock member mounted for pivoting motion on the other of said carriages, said lock member having a first finger to extend through an opening in a bottom wall of said other carriage and abut against an opposite side wall of said channel, and having a second finger to extend through the same or another opening in said carriage bottom wall and to engage into a selected one of the slot openings.

31. A roller skate, comprising:

a platform to support a skater's foot, at least one roller mounted movably with respect to the platform, a brake pad of frictional material attached to said platform and engageable by said roller, the brake pad being provided integrally with a projection frictionally to engage the skating surface when the platform is tilted, the roller skate further including a forward carriage and a rearward carriage, length adjustment means interconnecting the forward and rearward carriages, and locking means to lock the interconnected forward and rearward carriages in a selected one of a plurality of predetermined relative positions, and wherein the locking means comprises, to each side of a longitudinal central skate axis:

an elongate channel having one side wall formed with a plurality of slot openings depending from one of said carriages, and a lock member mounted for pivoting motion on the other of said carriages, the lock member having a first finger to extend through an opening in a bottom wall of said other carriage and abut against an opposite side wall of said channel, and having a second finger to extend through the same or another opening in said carriage bottom wall and to engage into a selected one of the slot openings.

* * * * *